US010902789B2

(12) United States Patent
Park

(10) Patent No.: US 10,902,789 B2
(45) Date of Patent: Jan. 26, 2021

(54) DISPLAY DEVICE IN WHICH ALIASING IN AN IMAGE FRAME IS RELAXED FOR VARIOUS PIXEL ARRANGEMENT STRUCTURES

(71) Applicant: Samsung Display Co., Ltd., Yongin-si (KR)

(72) Inventor: Jong Woong Park, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/379,338

(22) Filed: Apr. 9, 2019

(65) Prior Publication Data

US 2019/0385534 A1 Dec. 19, 2019

(30) Foreign Application Priority Data

Jun. 15, 2018 (KR) ..... 10-2018-0069109

(51) Int. Cl.
*G09G 3/3275* (2016.01)
*G09G 3/3225* (2016.01)

(52) U.S. Cl.
CPC ..... *G09G 3/3275* (2013.01); *G09G 3/3225* (2013.01); *G09G 2360/16* (2013.01)

(58) Field of Classification Search
CPC ..... G09G 3/3275; G09G 3/3225
See application file for complete search history.

(56) References Cited

U.S. PATENT DOCUMENTS 5,796,409 A * 8/1998 Hersch ..... B41B 19/00 345/468
5,821,913 A * 10/1998 Mamiya ..... G09G 3/3611 345/88
6,021,256 A * 2/2000 Ng ..... G06K 15/00 358/1.9
6,542,161 B1 * 4/2003 Koyama ..... G09G 5/28 345/589
7,222,306 B2 * 5/2007 Kaasila ..... G06F 3/0481 715/801
7,675,492 B2 3/2010 Park et al.
2005/0030302 A1 * 2/2005 Nishi ..... G09G 3/20 345/204
2005/0151752 A1 * 7/2005 Phan ..... G09G 3/2003 345/589
2011/0050918 A1 * 3/2011 Tachi ..... H04N 5/217 348/208.4
2012/0162528 A1 * 6/2012 Kiuchi ..... H04N 19/513 348/607
2013/0076609 A1 * 3/2013 Inada ..... G09G 3/3648 345/88
2013/0258145 A1 * 10/2013 Nakaseko ..... H04N 5/347 348/246

FOREIGN PATENT DOCUMENTS

KR 10-1348753 1/2014

* cited by examiner

*Primary Examiner* — William Boddie
*Assistant Examiner* — Andrew B Schnirel
(74) *Attorney, Agent, or Firm* — H.C. Park & Associates, PLC

(57) ABSTRACT

A display device providing grayscale correction to pixels in a plurality of dots which cat display an image frame in which aliasing is relaxed for various pixel arrangement structures.

20 Claims, 19 Drawing Sheets

DISPLAY DEVICE IN WHICH ALIASING IN AN IMAGE FRAME IS RELAXED FOR VARIOUS PIXEL ARRANGEMENT STRUCTURES

CROSS-REFERENCE TO RELATED APPLICATION

The application claims priority from and the benefit of Korean Patent Application No. 10-2018-0069109, filed on Jun. 15, 2018, which is hereby incorporated by reference for all purposes as if fully set forth herein.

BACKGROUND

Field

Exemplary embodiments of the invention relate to a display device.

Discussion of the Background

With the development of information technology, the importance of display devices, which are a connection medium between users and information, has been emphasized. In response to this, the use of display devices, such as a liquid crystal display device, an organic light emitting display device, and a plasma display device, has been increasing.

A display device writes a data voltage corresponding to each pixel, and causes each pixel to emit light. Each pixel emits light with a luminance corresponding to the written data voltage.

The pixels of adjacent different single-color hues can be grouped and the unit of such a group can be defined as a dot. Each dot can represent more colors by a combination of the single-color hues. Pictures, characters, etc. of image frames can be expressed in dot units.

However, because the dots have a larger size than the pixels, aliasing in pictures, characters, etc. of the image frames expressed in dot units can be viewed by the user.

The above information disclosed in this Background section is only for understanding of the background of the inventive concepts, and, therefore, it may contain information that does not constitute prior art.

SUMMARY

Exemplary embodiments of the invention provide a display device capable of displaying an image frame in which aliasing is relaxed with respect to various pixel arrangement structures.

Additional features of the inventive concepts will be set forth in the description which follows, and in part will be apparent from the description, or may be learned by practice of the inventive concepts.

An exemplary embodiment of the invention provides a display device including a first dot including a first pixel, a second pixel, and a third pixel, wherein the third pixel is located in a first direction from the first pixel and the second pixel and the first pixel is located in a second direction from the second pixel; a second dot adjacent to the first dot in the first direction; a third dot adjacent to the first dot in a direction opposite to the first direction; a timing controller receiving grayscale values of the first to third dots for an image frame from an external processor; a grayscale correction unit generating a first corrected grayscale value and a second corrected grayscale value based on a first grayscale value corresponding to the first pixel and a second grayscale value corresponding to the second pixel when the first dot is determined as an edge of an object included in the image frame based on the grayscale values of the first to third dots; and a data driver supplying a first data voltage corresponding to the first corrected grayscale value to the first pixel, supplying a second data voltage corresponding to the second corrected grayscale value to the second pixel, and supplying a third data voltage corresponding to the third grayscale value to the third pixel.

The grayscale correction unit may include a first dot detection unit outputting a first detection signal when an edge value of the first dot calculated based on the grayscale values of the first to third dots is equal to or greater than a threshold value.

The grayscale correction unit may further include a first dot conversion unit converting the first grayscale value into the first corrected grayscale value and converting the second grayscale value into the second corrected grayscale value when the first detection signal is inputted. The first corrected grayscale value and the second corrected grayscale value are equal to each other.

The first dot conversion unit may set an average value of the first grayscale value and the second grayscale value as the first corrected grayscale value and the second corrected grayscale value.

A luminance of the first pixel may be lower than a luminance of the second pixel with respect to a same grayscale value, and the first dot conversion unit sums a value obtained by applying the first weight value to the first grayscale value and a value obtained by applying the second weight value to the second grayscale value to set the first corrected grayscale value and the second corrected grayscale value as a sum. The first weight value may be less than the second weight value.

A luminance of the first pixel may be greater than a luminance of the second pixel with respect to a same grayscale value, and the first dot conversion unit sums a value obtained by applying the first weight value to the first grayscale value and a value obtained by applying the second weight value to the second grayscale value to set the first corrected grayscale value and the second corrected grayscale value as a sum. The first weight value may be greater than the second weight value.

The display device may further include a fourth dot including a fourth pixel, a fifth pixel and a sixth pixel, wherein the sixth pixel is located in the first direction from the fourth pixel and the fifth pixel and the fourth pixel is located in the second direction from the fifth pixel; a fifth dot adjacent to the fourth dot in the second direction; and a sixth dot adjacent to the fourth dot in a direction opposite to the second direction. The timing controller may receive grayscale values of the fourth to sixth dots for the image frame from the processor, and the grayscale correction unit further includes a second dot detection unit outputting a second detection signal when the fourth dot is determined as a dot adjacent to the edge of the object included in the image frame based on the grayscale values of the fourth to sixth dots.

The grayscale correction unit may further include a second dot conversion unit selecting one of a fourth grayscale value corresponding to the fourth pixel and a fifth grayscale value corresponding to the fifth pixel based on the second detection signal when the second detection signal is inputted, and generating a third corrected grayscale value by decreasing the selected grayscale value.

The data driver may supply a data voltage corresponding to the third corrected grayscale value to the fourth pixel when the second dot conversion unit decreases the fourth grayscale value to generate the third corrected grayscale value.

The data driver may supply a data voltage corresponding to the third corrected grayscale value to the fifth pixel when the second dot conversion unit decreases the fifth grayscale value to generate the third corrected grayscale value.

The processor may provide the first to third grayscale values so that the first to third grayscale values are different from each other and the second grayscale value is a value between the first grayscale value and the third grayscale value when the first dot constitutes an edge dot of a letter in the image frame.

The first dot detection unit may apply a Prewitt mask of a single row in which the first direction is a row direction to the first to third dots to calculate the edge value of the first dot.

The first dot detection unit may calculate the edge value of the first dot using a Prewitt mask or a Sobel mask of a plurality of rows in which the first direction is a row direction and the second direction is a column direction.

The grayscale correction unit may further include a first dot conversion unit converting the first grayscale value to the first corrected grayscale value and converting the second grayscale value to the second corrected grayscale value when the first detection signal is inputted. A sum of the first grayscale value and the second grayscale value may be equal to a sum of the first corrected grayscale value and the second corrected grayscale value.

A luminance of the first pixel may be lower than a luminance of the second pixel with respect to a same grayscale value, and the first corrected grayscale value may be higher than the second corrected grayscale value.

A luminance of the second pixel may be lower than a luminance of the first pixel with respect to a same grayscale value, and the second corrected grayscale value may be higher than the first corrected grayscale value.

The luminance of the first pixel corresponding to the first data voltage and the luminance of the second pixel corresponding to the second data voltage may be the same.

Another exemplary embodiment of the invention provides a display device including a first dot including a first pixel, a second pixel, and a third pixel, wherein the first pixel is located in a first direction from the second pixel and the first pixel and the second pixel are located in a second direction from the third pixel; a second dot adjacent to the first dot in the first direction; a third dot adjacent to the first dot in a direction opposite to the first direction; a timing controller receiving grayscale values of the first to third dots for an image frame from an external processor; a grayscale correction unit generating a first corrected grayscale value and a second corrected grayscale value based on a first grayscale value corresponding to the first pixel and a second grayscale value corresponding to the second pixel when the first dot is determined as an edge of an object included in the image frame based on the grayscale values of the first to third dots; and a data driver supplying a first data voltage corresponding to the first corrected grayscale value to the first pixel, supplying a second data voltage corresponding to the second corrected grayscale value to the second pixel, and supplying a third data voltage corresponding to the third grayscale value to the third pixel.

The grayscale correction unit may include a first dot detection unit outputting a first detection signal when an edge value of the first dot calculated based on the grayscale values of the first to third dots is equal to or greater than a threshold value.

The grayscale correction unit may further include a first dot conversion unit converting the first grayscale value to the first corrected grayscale value and converting the second grayscale value to the second corrected grayscale value when the first detection signal is inputted. The first corrected grayscale value and the second corrected grayscale value may be equal to each other.

Another exemplary embodiment of the invention provides a display device including a seventh dot including a seventh pixel, an eighth pixel, and a ninth pixel, wherein the ninth pixel is located in a first direction from the seventh pixel and the eighth pixel and the seventh pixel is located in a second direction from the eighth pixel; an eighth dot adjacent to the seventh dot in the first direction and including a tenth pixel, an eleventh pixel, and a twelfth pixel, wherein the twelfth pixel is located in the first direction from the tenth pixel and the eleventh pixel and the tenth pixel is located in the second direction from the eleventh pixel; a ninth dot adjacent to the seventh dot in a direction opposite to the second direction and including a thirteenth pixel, a fourteenth pixel, and a fifteenth pixel, wherein the fifteenth pixel is located in the first direction from the thirteenth pixel and the fourteenth pixel and the thirteenth pixel is located in the second direction from the fourteenth pixel; a tenth dot adjacent to the ninth dot in the first direction and including a sixteenth pixel, a seventeenth pixel, and an eighteenth pixel, wherein the eighteenth pixel is located in the first direction from the sixteenth pixel and the seventeenth pixel and the sixteenth pixel is located in the second direction from the seventeenth pixel; a timing controller receiving grayscale values of the ninth and tenth dots for an image frame from an external processor; a grayscale correction unit generating a fourth corrected grayscale value based on grayscale values of the seventh pixel, the tenth pixel, the thirteenth pixel, and the sixteenth pixel, generating a fifth corrected grayscale value based on grayscale values of the eighth pixel, the eleventh pixel, the fourteenth pixel, and the seventeenth pixel, and generating a sixth corrected grayscale value based on grayscale values of the ninth pixel, the twelfth pixel, the fifteenth pixel, and the eighteenth pixel; and a data driver supplying a data voltage corresponding to the fourth corrected grayscale value to the seventh pixel, supplying a data voltage corresponding to the fifth corrected grayscale value to the eighth pixel, and supplying a data voltage corresponding to the sixth grayscale value to the ninth pixel.

In generating the fourth corrected grayscale value, a weight value of the grayscale value of the seventh pixel among the grayscale values of the seventh pixel, the tenth pixel, the thirteenth pixel, and the sixteenth pixel may be the greatest. In generating the fifth corrected grayscale value, a weight value of the grayscale value of the eighth pixel among the grayscale values of the eighth pixel, the eleventh pixel, the fourteenth pixel, and the seventeenth pixel may be the greatest. In generating the sixth corrected grayscale value, a weight value of the grayscale value of the ninth pixel among the grayscale values of the ninth pixel, the twelfth pixel, the fifteenth pixel, and the eighteenth pixel may be the greatest.

A sum of the weight value for the seventh dot, the weight value for the eighth dot, and the weight value for the tenth dot may be 1.

The weight value for the seventh dot may be in a range from 0.5 to 0.75, the weight value for the eighth dot may be in a range from 0.1 to 0.15, the weight value for the ninth dot may be in a range from 0.1 to 0.15, and the weight value for the tenth dot may be in a range from 0.1 to 0.15.

The weight value for the seventh dot may be 0.625, the weight value for the eighth dot may be 0.125, the weight value for the ninth dot may be 0.125, and the weight value for the tenth dot may be 0.125.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the inventive concepts.

DETAILED DESCRIPTION

Figure 1:
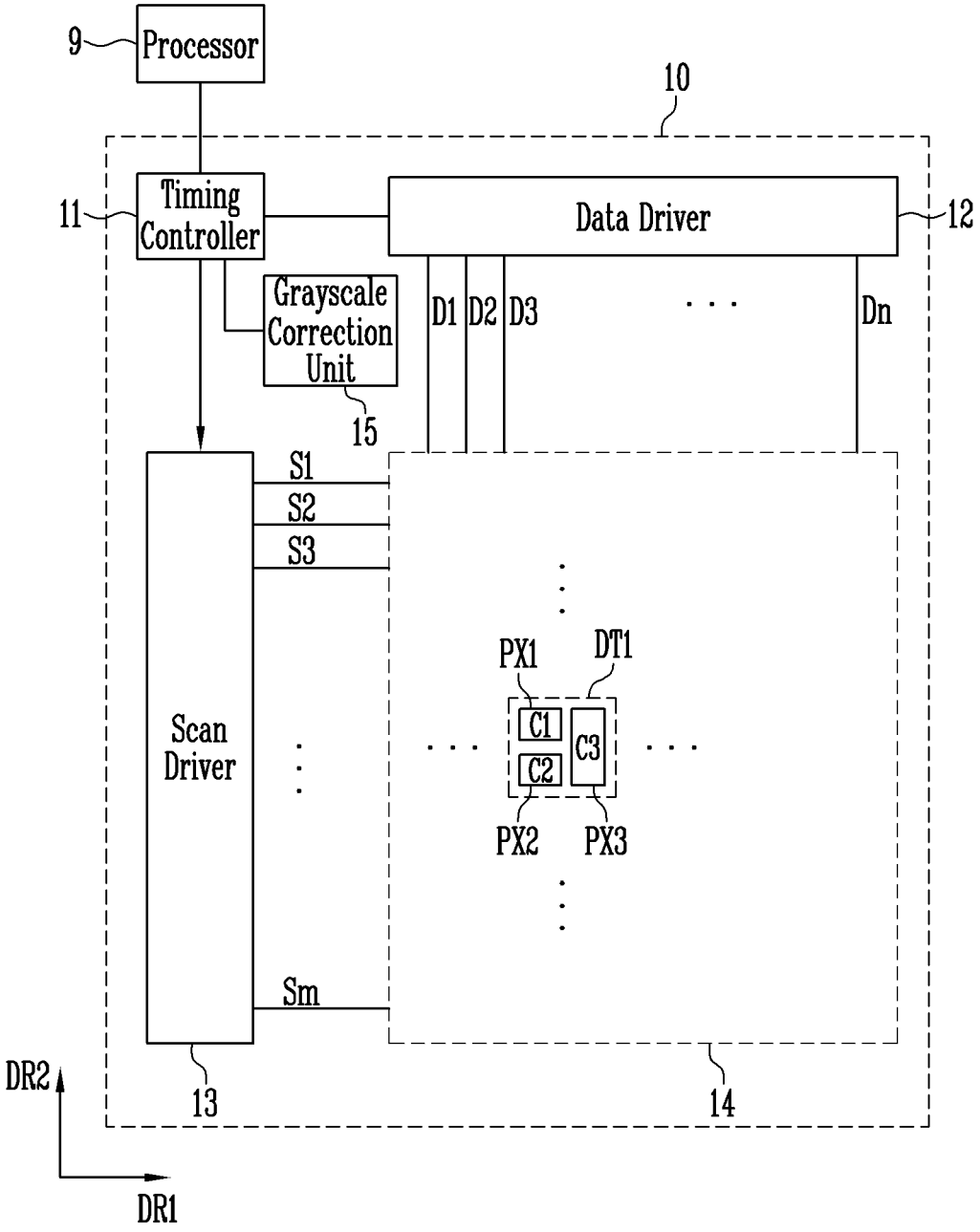
FIG. 1 is a block diagram for explaining a display device according to an exemplary embodiment of the invention.

In the following description, for the purposes of explanation, numerous specific details are set forth in order to provide a thorough understanding of various exemplary embodiments of the invention. As used herein "embodiments" are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

In the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z-axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

As is customary in the field, some exemplary embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some exemplary embodiments may be physically separated into two or more interacting and discrete blocks, units, and/or modules without departing from the scope of the inventive concepts. Further, the blocks, units, and/or modules of some exemplary embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

FIG. 1 is a block diagram for explaining a display device 10 according to an exemplary embodiment of the invention.

Referring to FIG. 1, the display device 10 according to an exemplary embodiment of the invention may include a timing controller 11, a data driver 12, a scan driver 13, a pixel unit 14, and a grayscale correction unit 15.

A processor 9 may be a general purpose processing device. For example, the processor 9 may be an application processor (AP), a central processing unit (CPU), a graphics processing unit (GPU), a micro controller unit (MCU), or another host system.

The processor 9 may provide control signals necessary for displaying an image frame and grayscale values for each pixel to the timing controller 11. The control signals may include, for example, a data enable signal, a vertical synchronization signal, a horizontal synchronization signal, a target maximum luminance, and the like.

The timing controller 11 may provide a clock signal, a scan start signal, and the like to the scan driver 13 so as to conform to specifications of the scan driver 13 based on the received control signals. In addition, the timing controller 11 may provide the data driver 12 with grayscale values and control signals that have been modified or maintained to conform to the specifications of the data driver 12 based on the received grayscale values and control signals.

The data driver 12 may generate data voltages to be provided to data lines D1, D2, D3, . . . , Dn using the grayscale values and the control signals received from the timing controller 11. For example, the data voltages generated in units of pixel rows may be simultaneously applied to the data lines D1 to Dn according to output control signals included in the control signals.

The scan driver 13 may receive the control signals such as a clock signal, a scan start signal, and the like from the timing controller 11 and may generate scan signals to be supplied to the scan lines S1, S2, S3, . . . , Sm. For example, the scan driver 13 may sequentially provide turn-on level scan signals to the scan lines S1 to Sn. For example, the scan driver 13 may be configured in the form of a shift register and may generate scan signals in a manner that sequentially transfers the scan start signal to the next stage circuit under the control of the clock signal.

The pixel unit 14 includes pixels . . . , PX1, PX2, PX3, . . . . Each pixel . . . , PX1, PX2, PX3, . . . may be connected to a corresponding data line and a corresponding scan line. For example, when the data voltages for one pixel row are applied to the data lines D1 to Dn from the data driver 12, the data voltages may be written to the pixel row connected to the scan line supplied with the scan signal of the turn-on level from the scan driver 13. This driving method will be described in more detail with reference to FIGS. 2 and 3.

Each pixel . . . , PX1, PX2, PX3, . . . can emit light in a single color. For example, a first pixel PX1 may emit light in a first color C1, a second pixel PX2 may emit light in a second color C2, and a third pixel PX3 may emit light in a third color C3. The color of each pixel can be determined by the size of a bandgap of an organic material of an organic light emitting diode OLED1 of FIG. 2 to be described below. The first, second, and third colors C1, C2, and C3 may be variously set according to the design of the display device 10. For example, the first, second, and third colors C1, C2, and C3 may correspond to red, green, and blue, respectively. The first, second, and third colors C1, C2, and C3 may correspond to green, red, and blue, respectively. The first, second, and third colors C1, C2, and C3 may correspond to green, blue, and red, respectively. The first, second, and third colors C1, C2, and C3 may correspond to blue, green, and red, respectively. The first, second, and third colors C1, C2, and C3 may correspond to red, blue, and green, respectively. In addition, the first, second, and third colors C1, C2, and C3 may correspond to blue, red, and green, respectively. In other embodiments, the first, second, and third colors C1, C2, and C3 may optionally correspond to cyan, magenta, and yellow.

The third pixel PX3 may be located in a first direction DR1 from the first pixel PX1 and the second pixel PX2 and the first pixel PX1 may be located in a second direction DR2 from the second pixel PX2. Hereinafter, positions of the pixels PX1, PX2, and PX3 will be described with reference to the light emitting regions of the pixels PX1, PX2, and PX3. Circuit regions of the pixels PX1, PX2, and PX3 may not coincide with the corresponding light emitting regions.

A first dot DT1 may be defined as a group of the first pixel PX1, the second pixel PX2, and the third pixel PX3. Such a pixel layout structure may be referred to as an S-stripe structure. Unlike the RGB-stripe structure to be described below, the S-stripe structure is advantageous in securing the aperture ratio of a fine metal mask (FMM) used in the deposition process of the organic light emitting diode. That is, the interval between the pixels of the same color can be increased.

The grayscale correction unit 15 may generate a first corrected grayscale value and a second corrected grayscale value based on a first grayscale value and a second grayscale value for the first pixel PX1 and the second pixel PX2 when the first dot DT1 is determined as an edge of an object included in the image frame. At this time, the timing controller 11 may provide the first corrected grayscale value to the first pixel PX1, the second corrected grayscale value to the second pixel PX2, and a third grayscale value not corrected to the third pixel PX3. Therefore, the data driver 12 may supply a first data voltage corresponding to the first corrected grayscale value to the first pixel PX1, a second data voltage corresponding to the second corrected grayscale value to the second pixel PX2, and a third data voltage corresponding to the third grayscale value to the third pixel PX3. Exemplary embodiments of the grayscale correction unit 15 will be described below with reference to FIGS. 11 to 18.

In one exemplary embodiment, the grayscale correction unit 15 and the timing controller 11 may exist as independent individual chips. In another exemplary embodiment, the grayscale correction unit 15 and the timing controller 11 may exist as an integrated single chip. For example, the grayscale correction unit 15 and the timing controller 11 may exist as a single integrated circuit IC.

Hereinafter, the display device 10 will be described on the basis of the organic light emitting display device. However, those skilled in the art will understand that if a pixel circuit of FIGS. 2 and 3 is replaced, the display device 10 can also be applied to a liquid crystal display device.

Figure 2:
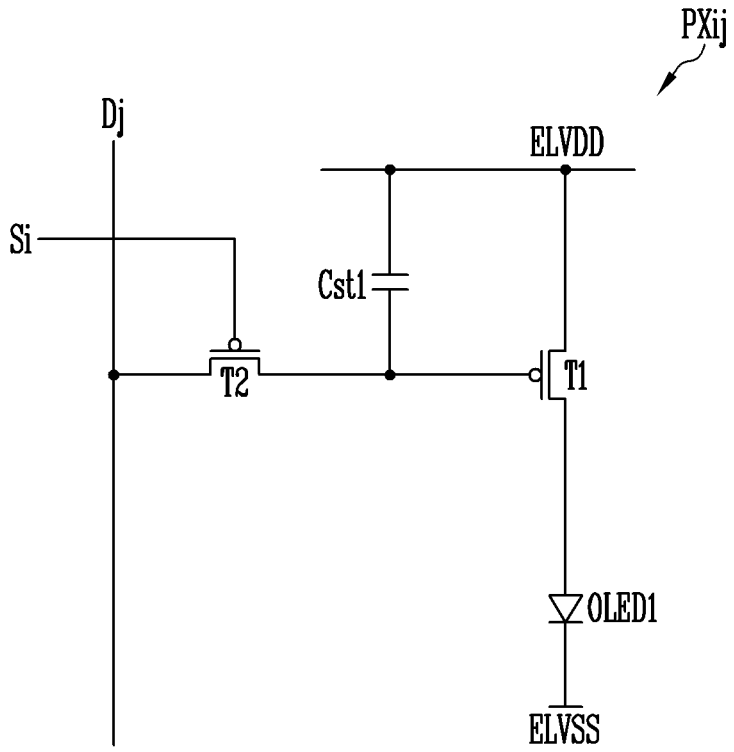
FIG. 2 is a circuit diagram for explaining a pixel according to the exemplary embodiment of FIG. 1.
Figure 3:
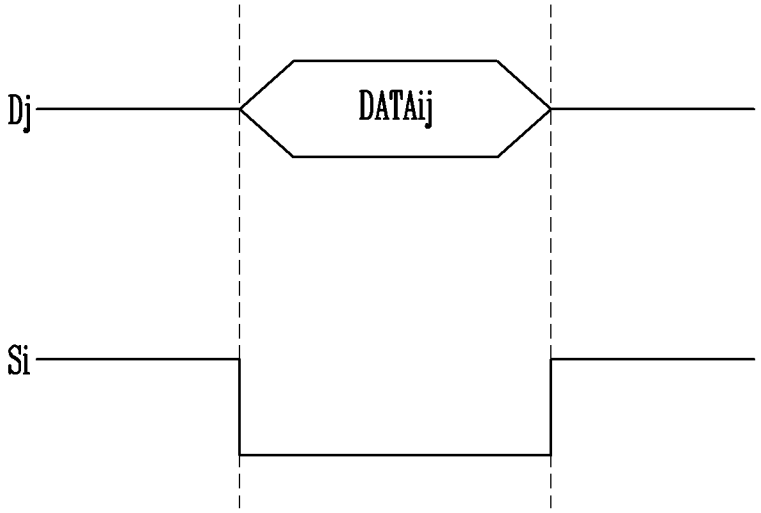
FIG. 3 is a diagram for explaining a driving method of the pixel of FIG. 2.

FIG. 2 is a circuit diagram for explaining a pixel according to the exemplary embodiment of FIG. 1 and FIG. 3 is a diagram for explaining a driving method of the pixel of FIG. 2.

Referring to FIG. 2, a circuit structure of an exemplary pixel PXij is shown.

It is assumed that the pixel PXij is connected to an arbitrary i-th scan line Si and a j-th data line Dj. The first, second and third pixels PX1, PX2, and PX3 may include a circuit structure of the pixel Pxij.

The pixel PXij may include a plurality of transistors T1 and T2, a storage capacitor Cst1, and an organic light emitting diode OLED1. Although the transistors T1 and T2 are shown as P-type transistors in this exemplary embodiment, those skilled in the art will be able to construct a pixel circuit having the same function as an N-type transistor.

The transistor T2 may include a gate electrode connected to the scan line Si, one electrode connected to the data line Dj, and the other electrode connected to a gate electrode of the transistor T1. The transistor T2 may be referred to as a switching transistor, a scan transistor, or the like.

The transistor T1 may include a gate electrode connected to the other electrode of the transistor T2, one electrode connected to a first power supply voltage line ELVDD and the other electrode connected to an anode electrode of the organic light emitting diode OLED1. The transistor T1 may be referred to as a driving transistor.

The storage capacitor Cst1 connects the one electrode and the gate electrode of the transistor T1.

The organic light emitting diode OLED1 includes the anode electrode connected to the other electrode of the transistor T1 and a cathode electrode connected to a second power supply voltage line ELVSS.

When a scan signal of a turn-on level (low level) is supplied to the gate electrode of the transistor T2 through the scan line Si, the transistor T2 connects the data line Dj and one electrode of the storage capacitor Cst1. Therefore, a voltage value corresponding to the difference between a data voltage DATAij applied through the data line Dj and the first power supply voltage is written to the storage capacitor Cst1. The transistor T1 causes a driving current determined according to the voltage value written to the storage capacitor Cst1 to flow from the first power supply voltage line ELVDD to the second power supply voltage line ELVSS. The organic light emitting diode OLED1 emits light with a luminance corresponding to the amount of the driving current.

Figure 4:
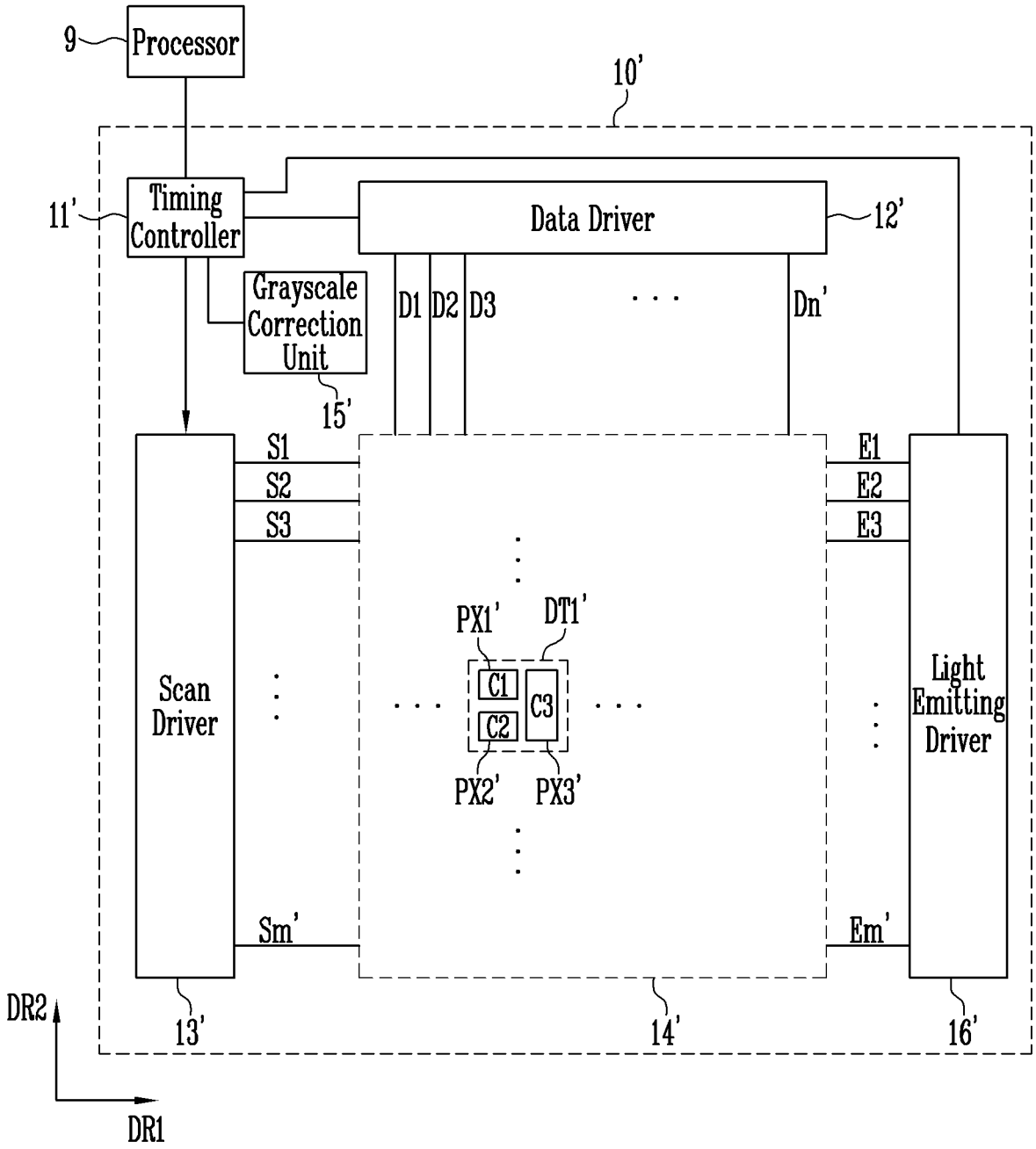
FIG. 4 is a block diagram for explaining a display device according to another exemplary embodiment of the invention.

FIG. 4 is a block diagram for explaining a display device 10' according to another exemplary embodiment of the invention.

Referring to FIG. 4, the display device 10' may include a timing controller 11', a data driver 12', a scan driver 13', a pixel unit 14', a grayscale correction unit 15', and a light emitting driver 16'.

Compared with the exemplary embodiment of FIG. 1, the display device 10' further includes the light emitting driver 16'. The other elements of the display device 10' other than the light emitting driver 16' may be the same as or similar to those of the display device 10 of FIG. 1, and thus, duplicate descriptions are omitted.

The light emitting driver 16' may supply light emitting signals for determining light emitting periods of the pixels . . . , PX1', PX2', PX3', . . . of the pixel unit 14' to light emitting lines E1, E2, E3, . . . , Em'. The light emitting driver 16' may supply the light emitting signals of a turn-off level to the light emitting lines E1 to Em' in a period in which the corresponding scan signal of the turn-on level is supplied. According to one exemplary embodiment, the light emitting driver 16' may be of a sequential light emitting type. The light emitting driver 16' may be configured in the form of a shift register and may generate the light emitting signals by sequentially transmitting light emitting start signals to the next stage circuit under the control of a clock signal. According to another exemplary embodiment, the light emitting driver 16' may be a simultaneous light emitting type in which all the pixel rows are simultaneously emitted.

Figure 5:
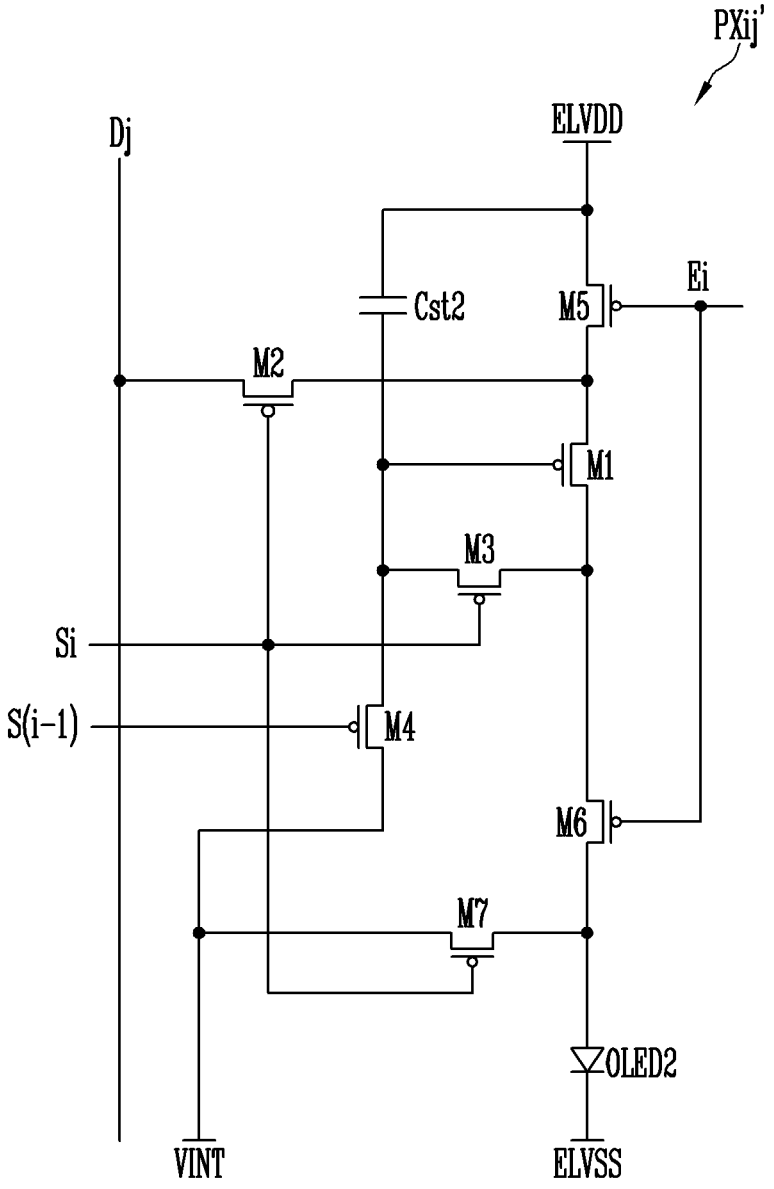
FIG. 5 is a circuit diagram for explaining a pixel according to the embodiment of FIG. 4.

FIG. 5 is a circuit diagram for explaining the pixel according to the exemplary embodiment of FIG. 4.

Referring to FIG. 5, a pixel PXij' may include transistors M1, M2, M3, M4, M5, M6, and M7, a storage capacitor Cst2, and an organic light emitting diode OLED2.

The storage capacitor Cst2 may include one electrode connected to the first power supply voltage line ELVDD and the other electrode connected to a gate electrode of the transistor M1.

The transistor M1 may include one electrode connected to the other electrode of the transistor M5, the other electrode connected to the one electrode of the transistor M6, and the gate electrode connected to the other electrode of the storage capacitor Cst2. The transistor M1 may be referred to as a driving transistor. The transistor M1 determines the amount of driving current flowing between the first power supply voltage line ELVDD and the second power supply voltage line ELVSS according to the potential difference between the gate electrode and the source electrode thereof.

The transistor M2 may include one electrode connected to the data line Dj, the other electrode connected to the one electrode of the transistor M1, and a gate electrode connected to the current scan line Si. The transistor M2 may be referred to as a switching transistor, a scan transistor, or the like. The transistor M2 may transfer the data voltage of the data line Dj to the pixel PXij when a scan signal of a turn-on level is applied to the current scan line Si.

The transistor M3 may include one electrode connected to the other electrode of the transistor M1, the other electrode connected to the gate electrode of the transistor M1, and a gate electrode connected to the current scan line Si. The transistor M3 connects the transistor M1 in a diode form when a scan signal of a turn-on level is applied to the current scan line Si.

The transistor M4 may include one electrode connected to the gate electrode of the transistor M1, the other electrode connected to an initialization voltage line VINT, and a gate electrode connected to a previous scan line S(i−1). In another exemplary embodiment, the gate electrode of the transistor M4 may be connected to another scan line. The transistor M4 transfers an initialization voltage VINT to the gate electrode of the transistor M1 to initialize the amount of charge of the gate electrode of the transistor M1 when the scan signal of the turn-on level is applied to the previous scan line S(i−1).

The transistor M5 may include one electrode connected to the first power supply voltage line ELVDD, the other electrode connected to the one electrode of the transistor M1, and a gate electrode connected to a light emitting line Ei. The transistor M6 may include one electrode connected to the other electrode of the transistor M1, the other electrode connected to an anode electrode of the organic light emitting diode OLED2, and a gate electrode connected to the light emitting line Ei. The transistors M5 and M6 may be referred to as a light emitting transistor. The transistors M5 and M6 form a driving current path between the first power supply voltage line ELVDD and the second power supply voltage line ELVSS to cause the organic light emitting diode OELD2 when a light emitting signal of a turn-on level is applied.

The transistor M7 may include one electrode connected to the anode electrode of the organic light emitting diode OLED2, the other electrode connected to the initialization voltage line VINT, and a gate electrode connected to the current scan line Si. In another exemplary embodiment, the gate electrode of the transistor M7 may be connected to another scan line. For example, the gate electrode of the transistor M7 may be connected to the next scan line (an (i+1)th scan line) or a subsequent scan line. The transistor M7 transfers the initialization voltage to the anode electrode of the organic light emitting diode OLED2 to initialize the amount of charge accumulated in the organic light emitting diode OELD2 when the scan signal of the turn-on level is applied to the current scan line Si.

The organic light emitting diode OELD2 may include the anode electrode connected to the other electrode of the transistor M6 and a cathode electrode connected to the second power supply voltage line ELVSS.

Figure 6:
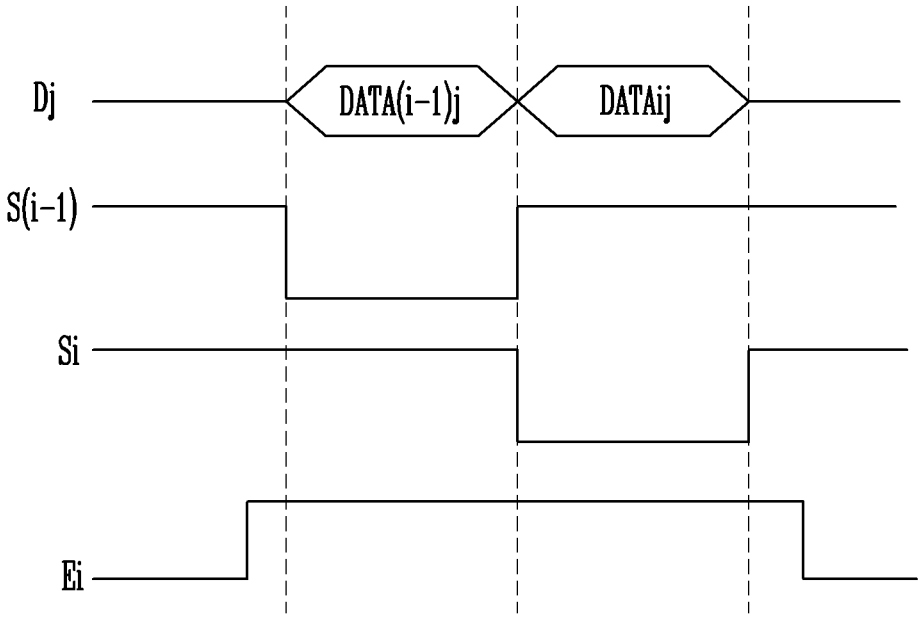
FIG. 6 is a diagram for explaining a driving method of the pixel of FIG. 5.

FIG. 6 is a diagram for explaining a driving method of the pixel of FIG. 5.

First, a data voltage DATA(i−1)j for a previous pixel row is applied to the data line Dj and the scan signal of the turn-on level (low level) is applied to the previous scan line S(i−1).

Since the scan signal of the turn-off level (high level) is applied to the current scan line Si, the transistor M2 is turned off and the data voltage for the previous pixel row (DATA (i−1)j) is not transferred to the pixel PXij.

At this time, since the transistor M4 is turned on, the initialization voltage is applied to the gate electrode of the transistor M1 to initialize the amount of charge. Since a light emitting control signal of a turn-off level is applied to the light emitting line Ei, the transistors M5 and M6 are turned off and unnecessary light emission of the organic light emitting diode OLED2 is prevented during the initialization voltage application process.

Next, a data voltage DATAij for a current pixel row is applied to the data line Dj and the scan signal of the turn-on level is applied to the current scan line Si. As a result, the transistors M2, M1, and M3 are turned on, and the data line Dj and the gate electrode of the transistor M1 are electrically connected. Therefore, the data voltage DATAij is applied to the other electrode of the storage capacitor Cst2 and the storage capacitor Cst2 accumulates the amount of charge corresponding to the difference between the voltage of the first power supply voltage line ELVDD and the data voltage DATAij.

At this time, since the transistor M7 is turned on, the anode electrode of the organic light emitting diode OLED2 is connected to the initialization voltage line VINT, and the organic light emitting diode OLED2 is precharged or initialized with the amount of charge corresponding to the voltage difference between the initialization voltage and the second power supply voltage line ELVSS.

Thereafter, the transistors M5 and M6 are turned on as the light emitting signal of the turn-on level is applied to the light emitting line Ei, the amount of the driving current passing through the transistor M1 is adjusted according to the amount of charge stored in the storage capacitor Cst2, and the driving current flows through the organic light emitting diode OLED2. The organic light emitting diode OLED2 emits light until the light emitting signal of the turn-off level is applied to the light emitting line Ei.

Figure 7:
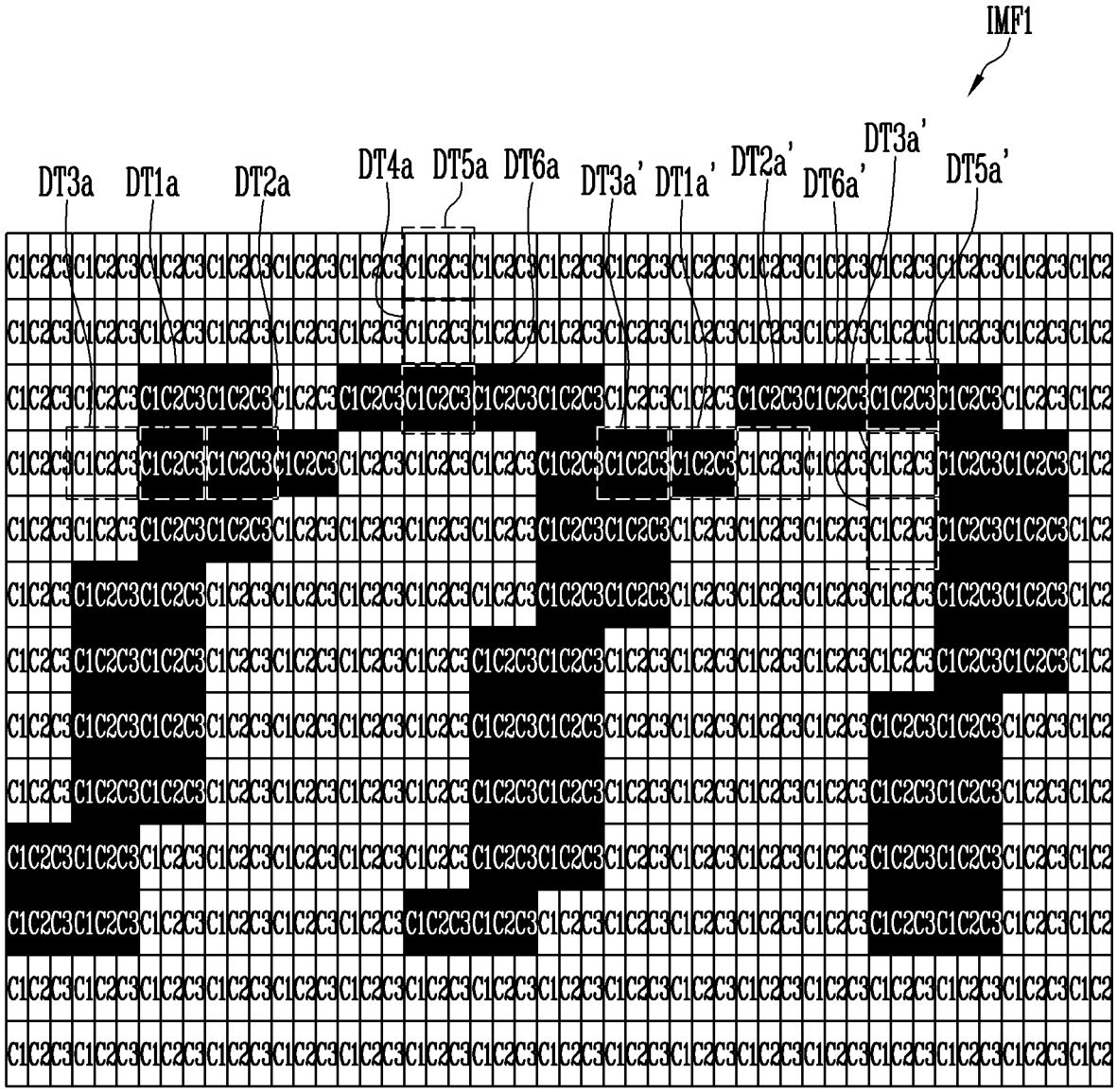
FIG. 7 is a diagram for explaining a first image frame to which anti-aliasing indicated in the RGB-stripe structure is not applied.

FIG. 7 is a diagram for explaining a first image frame IMF1 to which anti-aliasing indicated in the RGB-stripe structure is not applied.

The pixel unit for displaying the first image frame IMF1 of FIG. 7 has an RGB-stripe structure unlike the exemplary embodiments of FIGS. 1 and 4.

Referring to FIG. 7, each of dots DT1*a*, DT2*a*, DT3*a*, DT4*a*, DT5*a*, DT6*a*, DT1*a*', DT2*a*', DT3*a*', DT4*a*', DT5*a*', DT6*a*', . . . may include a pixel of the first color C1, a pixel of the second color C2, and a pixel of the third color C3 sequentially positioned in the first direction DR1. This pixel arrangement structure can be referred to as an RGB-stripe structure.

The processor 9 may provide the timing controller 11 with the grayscale values corresponding to the pixels so that the pixels have the desired luminance level for the first image frame IMF1. For example, when a grayscale value is represented by 8 bits, 256 ($=2^5$) grayscale levels can be expressed in each pixel. The number of bits representing each grayscale value may be varied according to the specifications of the processor 9 or the display device 10.

The processor 9 may provide grayscale values for the pixels to the timing controller 11 to display a character in the first image frame IMF1. Thus, the dots DT1*a*, DT2*a*, DT6*a*, DT3*a*', DT1*a*', DT5*a*', . . . constituting the character can display black color and the dots DT3*a*, DT4*a*, DT6*a*, DT2*a*', DT3*a*', DT6*a*', . . . which do not constitute the character can display white color.

For example, the processor 9 may provide all the grayscale values of the pixels included in the black dots as '0' and the grayscale values of the pixels included in the white dots as '255'.

However, because the dots have a larger size than the pixels, aliasing in the first image frame IMF1 in which a character is expressed in dot units may be viewed by the user.

Figure 8:
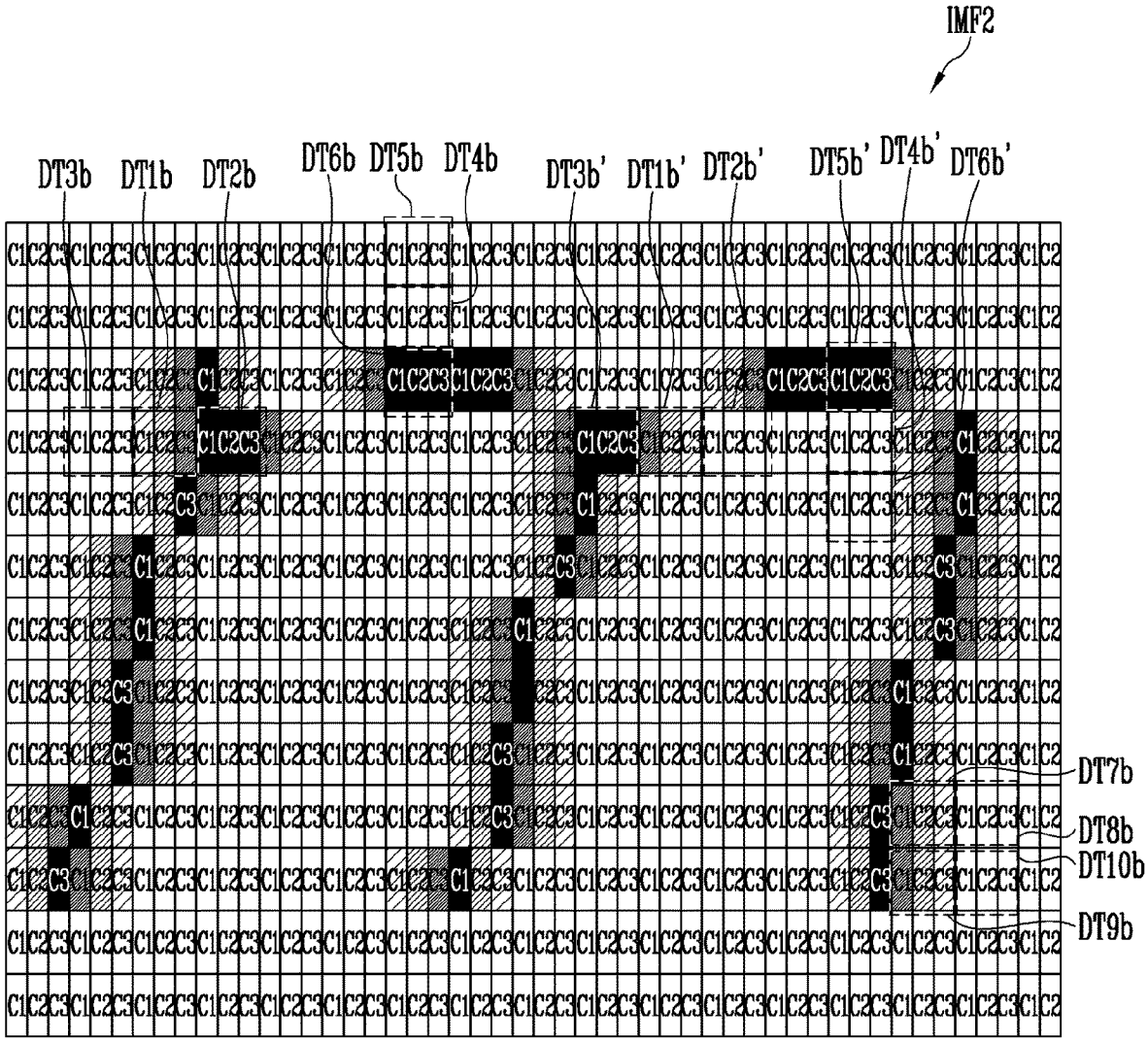
FIG. 8 is a diagram for explaining a second image frame to which anti-aliasing indicated in the RGB-stripe structure is applied.
Figure 9:
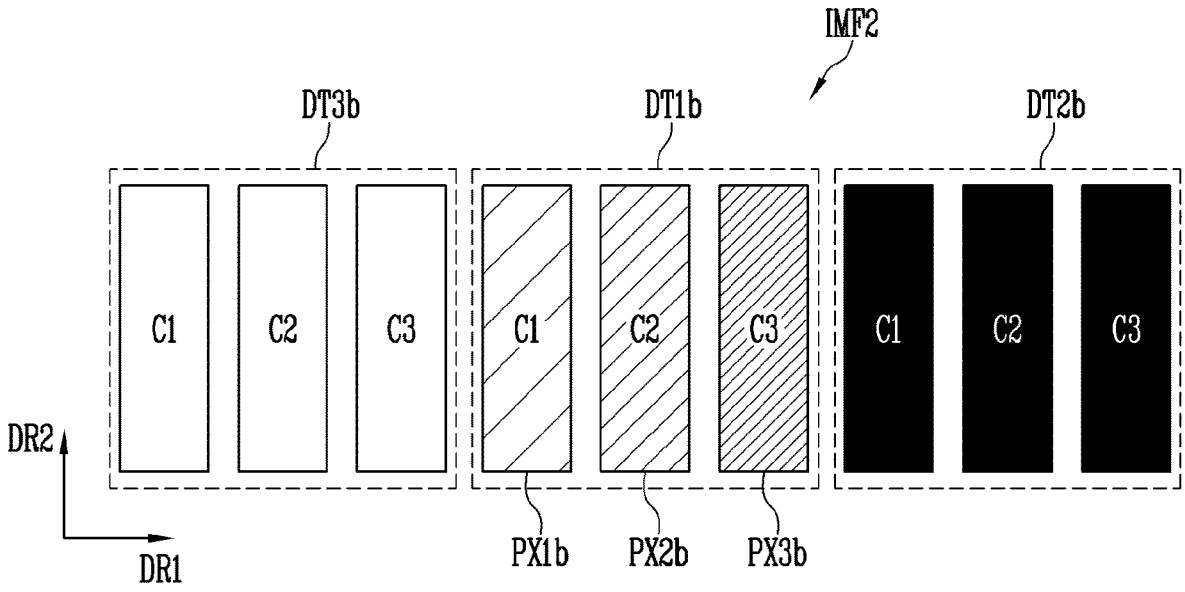
FIG. 9 is an enlarged view of the first to third dots of FIG. 8.

FIG. 8 is a diagram for explaining a second image frame to which anti-aliasing indicated in the RGB-stripe structure is applied and FIG. 9 is an enlarged view of the first to third dots of FIG. 8.

The pixel unit for displaying a second image frame IMF2 of FIG. 8 has an RGB-stripe structure, unlike the exemplary embodiments of FIGS. 1 and 4. The structure of the pixel unit of FIG. 8 may be the same as that of the pixel unit of FIG. 7.

Referring FIG. 8, each of dots DT1*b*, DT2*b*, DT3*b*, DT4*b*, DT5*b*, DT6*b*, DT1*b*', DT2*b*', DT3*b*', DT4*b*', DT5*b*', DT6*b*', . . . may include a pixel of the first color C1, a pixel of the second color C2, and a pixel of the third color C3 sequentially positioned in the first direction DR1.

The processor 9 may provide grayscale values for the second image frame IMF2 applied with anti-aliasing to the character of the first image frame IMF1 to the timing controller 11. The font of the character of the second image frame IMF2 of FIG. 8 may be different from that of the character of the first image frame IMF1 of FIG. 7. In one exemplary embodiment, the processor 9 does not convert the character of the first image frame IMF1 into the character of the second image frame IMF2 through a separate process and can include the character of the specific font whose grayscale values are determined so that the anti-aliasing effect appears in the second image frame IMF2. For example, a clear-type font provided in Windows™ may correspond to this exemplary embodiment. In another exemplary embodiment, the processor 9 may transform the grayscale values of the character of the first image frame IMF1 through an anti-aliasing algorithm to generate grayscale values of the character of the second image frame IMF2.

The processor 9 may provide grayscale values to the timing controller 11 so that the pixels of the dots DT1*b* and DT1*b*' constituting the edge of the character have sequentially rising or falling luminance levels. Here, the edge of the character may mean an edge located in the first direction DR1 or an edge located in a direction opposite to the first direction DR1 with respect to the character.

For example, referring to FIG. 9, the first dot DT1*b* constituting the edge of the character in the direction opposite to the first direction DR1 with respect to the character includes the first, second, and third pixels PX1*b*, PX2*b* and PX3*b*, and the processor 9 may provide first to third grayscale values so that the first, second, and third pixels PX1*b*, PX2*b*, and PX3*b* have sequentially falling luminance levels. That is, the first to third grayscale values are different from each other, and the second grayscale value may correspond to a value between the first grayscale value and the third grayscale value. For example, the processor 9 may provide the first grayscale value of "200" to the first pixel PX1*b*, the second grayscale value of "100" to the second pixel PX2*b*, and the third grayscale value of "50" to the third pixel PX3*b*.

At this time, the processor 9 may provide the grayscale value of "255" to the pixels of the third dot DT3*b* located in the direction opposite to the first direction DR1 of the first dot DT1*b* and may provide the grayscale value of "0" to the pixels of the second dot DT2*b* located in the first direction DR1 of the first dot DT1*b*.

Similarly, the first dot DT1*b*' constituting the edge of the character in the first direction DR1 with respect to the character includes the first to third pixels, and the processor 9 may provide first to third grayscale values so that the first to third pixels have sequentially rising luminance levels. That is, the first to third grayscale values are different from each other, and the second grayscale value may correspond to a value between the first grayscale value and the third grayscale value. For example, the processor 9 may provide the first grayscale value of "50" to the first pixel, the second grayscale value of "100" to the second pixel, and the third grayscale value of "200" to the third pixel.

At this time, the processor 9 may provide the grayscale value of "0" to the pixels of the third dot DT3*b*' located in the direction opposite to the first direction DR1 of the first dot DT1*b*' and may provide the grayscale value of "255" to the pixels of the second dot DT2*b*' located in the first direction DR1 of the first dot DT1*b*'.

Therefore, the user can observe and perceive the character included in the second image frame IMF2 of FIG. 8 more smoothly and clearly than the character included in the first image frame IMF1 of FIG. 7.

Figure 10:
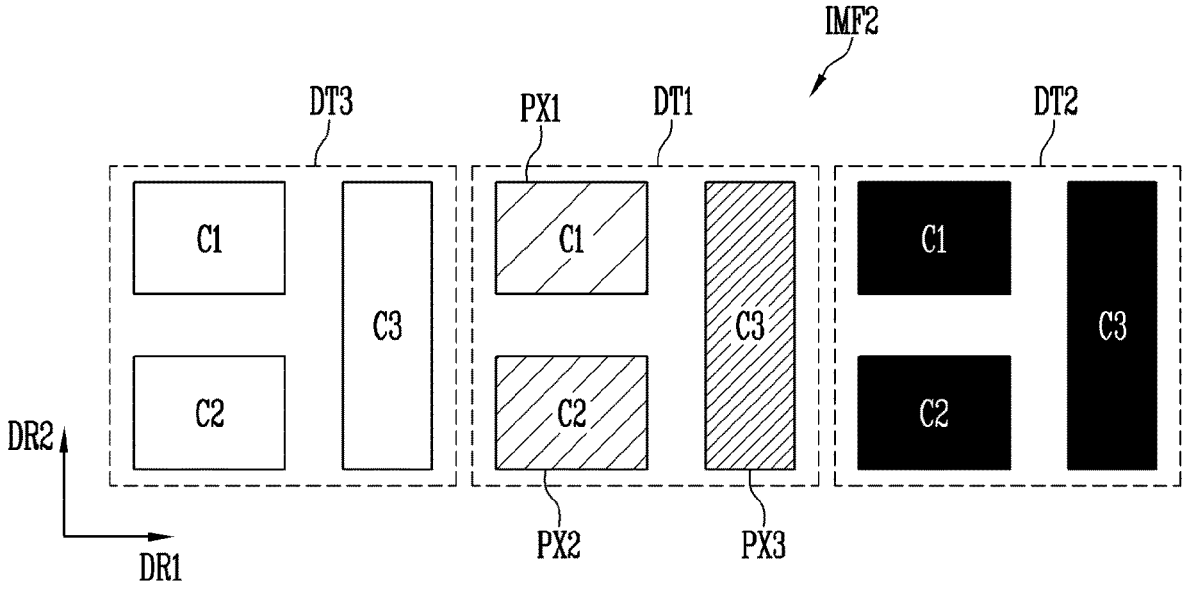
FIG. 10 is a diagram for explaining a case where a second image frame is displayed without correction of the S-stripe structure.

FIG. 10 is a diagram for explaining a case where the second image frame is displayed without correction in the S-stripe structure.

Referring to FIG. 10, the case where the grayscale values of the second image frame IMF2 provided by the processor 9 are applied to the pixel unit 14 of the display device 10 of FIG. 1 without correction is shown.

Since the second image frame IMF2 provided by the processor 9 is based on the RGB-stripe structure, when the grayscale values of the second image frame IMF2 are directly applied to the pixel unit 14 of the display device 10 having the S-stripe structure, the desired anti-aliasing effect cannot be obtained.

In the above example, in the second image frame IMF2, the first grayscale value of the first pixel PX1*b* is provided as "200", the second grayscale value of the second pixel PX2*b* is provided as "100", and the third grayscale value of the third pixel PX3*b* is provided as "50". In this case, the first grayscale value of the first pixel PX1 located in the same column in the second direction DR2 becomes "200" and the second grayscale value of the second pixel PX2 becomes "100" so that the displayed character has a serrated edge. Therefore, the first grayscale value and the second grayscale value require correction. However, since the relative location of the third pixel PX3 in the first dot DT1 of the S-stripe structure is the same as or similar to that of the third pixel PX3*b* in the first dot DT1*b* of the RGB-stripe structure, correction of the third grayscale value may be unnecessary.

Figure 11:
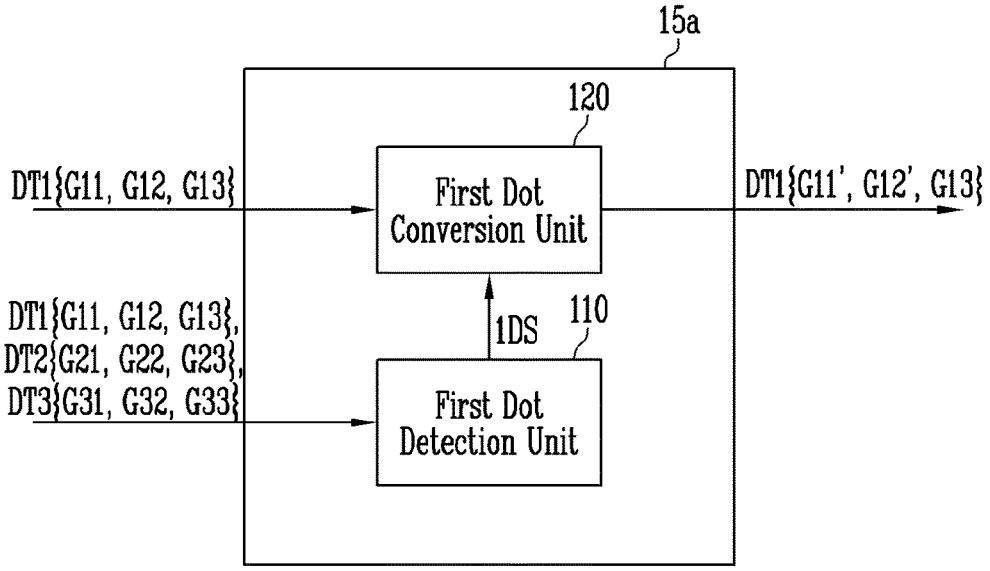
FIG. 11 is a block diagram for explaining a grayscale correction unit according to a first exemplary embodiment of the invention.
Figure 12:
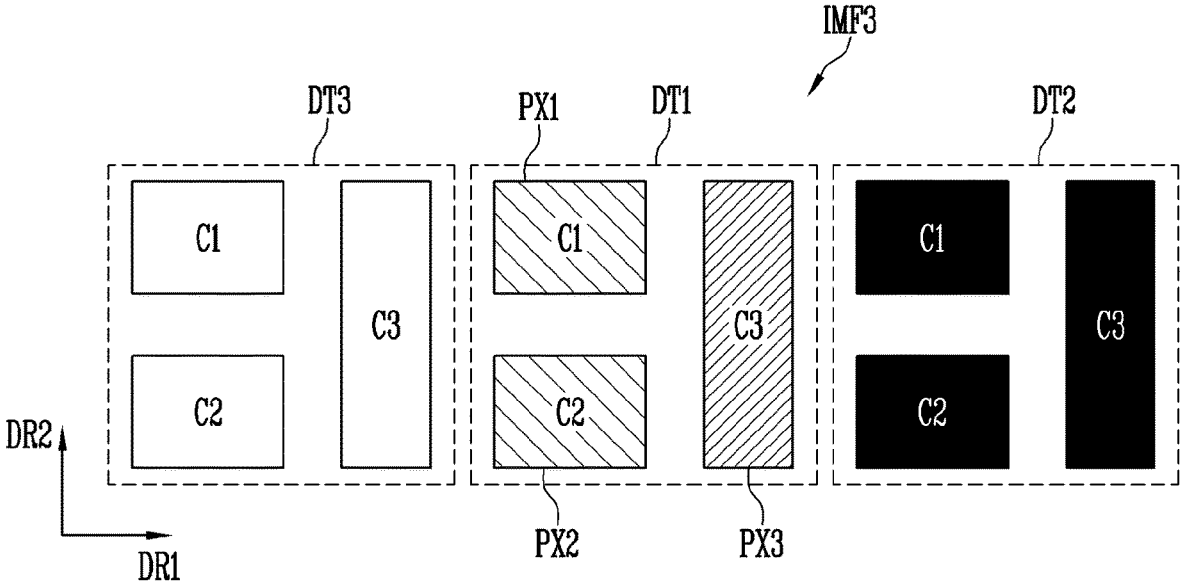
FIG. 12 is a diagram for explaining a third image frame in which the second image frame is corrected by the grayscale correction unit of the first exemplary embodiment.

FIG. 11 is a block diagram for explaining a grayscale correction unit 15*a* according to a first exemplary embodiment of the invention and FIG. 12 is a diagram for explaining a third image frame in which the second image frame is corrected by the grayscale correction unit 15*a* of the first exemplary embodiment.

Referring to FIG. 11, the grayscale correction unit 15*a* of the first exemplary embodiment may include a first dot detection unit 110 and a first dot conversion unit 120.

The first dot detection unit 110 may output a first detection signal 1DS when an edge value of the first dot DT1 calculated based on grayscale values G11, G12, G13, G21, G22, G23, G31, G32, and G33 of the first, second, and third dots DT1, DT2, and DT3 is equal to or larger than the threshold value.

It is necessary to detect which dots constitute the edge of the character before performing the correction unless the timing controller 11 receives information on the pixels constituting the character from the processor 9. However, since the display device 10 cannot discriminate whether the detected dot is the edge of the figure or the edge of the character, unless the display device 10 receives additional information from the processor 9. Hereinafter, a process of detecting the edge of an object by the first dot detection unit 110 will be described.

In the following description, the first dot detection unit 110 detects whether or not the target dot corresponds to the edge dot in dot units. For example, when there are three pixels constituting the dot, the average value of the grayscale values for the three pixels can be set as the value of the dot. At this time, the grayscale values of each pixel may be multiplied by a weight value according to an exemplary embodiment. Hereinafter, for the sake of convenience of explanation, the average value of the grayscale values constituting the dot will be described as the value of the dot, by setting the weight value for the grayscale value of each pixel to 1.

According to one exemplary embodiment, the first dot detection unit 110 applies a Prewitt mask of a single row in which the first direction DR1 is the row direction to the first, second, and third dots DT1, DT2, and DT3 to calculate the edge value of the dot DT1. For example, the Prewitt mask of the single row may correspond to Equation 1. In the case of using the Prewitt mask of the single row, the existing line buffer of the timing controller 11 can be used. Therefore, a separate line buffer is unnecessary, so that cost reduction is possible.

$$[-1\ 0\ 1] \qquad \text{Equation 1}$$

In Equation 1, "0" in the first row and the second column can be multiplied by the value of a discrimination target dot, "−1" in the first row and the first column can be multiplied by the value of the dot adjacent to a direction opposite to the first direction DR1 of the discrimination target dot, and "1" in the first row and the third column can be multiplied by the value of the dot adjacent to the first direction DR1 of the discrimination target dot. The sum of the multiplied values may correspond to the edge value of the discrimination target dot. Here, when the edge value is a negative number, it means that the grayscale value falls in the first direction DR1 with the discrimination target dot as a boundary. Also, when the edge value is a positive number, it means that the grayscale value rises in the first direction DR1 with the discrimination target dot as a boundary.

For example, referring to FIGS. 8, 9, and 10, a case where the third dot DT3 corresponds to the discrimination target dot will be described. Since grayscale values G31, G32 and G33 of the third dot DT3 are all "255", a value of the third dot DT3 is "255". A value of the dot adjacent to a direction opposite to the first direction DR1 of the third dot DT3 is "255". Since the grayscale values G11, G12 and G13 of the first dot DT1 adjacent to the first direction DR1 of the third dot DT3 are "200", "100" and "50", respectively, a value of the first dot DT1 is "116". For convenience, the fractional part is clipped. Therefore, when Equation 1 is applied with the third dot DT3 as the discrimination target dot, the edge value of the third dot DT3 becomes "−139" by the following Equation 2.

$$255*(-1)+255*0+116*1=-139 \qquad \text{Equation 2}$$

For example, referring to FIGS. 8 and 9, a case where the first dot DT1 corresponds to the discrimination target dot will be described. As described above, the value of the first dot DT1 is "116" and the value of the third dot DT3 is "255". Since grayscale values G21, G22 and G23 of the second dot DT2 are "0", a value of the second dot DT2 is "0". Therefore, when Equation 1 is applied with the first dot DT1 as the discrimination target dot, the edge value of the first dot DT1 becomes '−255' by the following Equation 3.

$$255*(-1)+116*0+0*1=-255 \qquad \text{Equation 3}$$

For example, referring to FIGS. 8 and 9, a case where the second dot DT2 corresponds to the discrimination target dot will be described. As described above, the value of the second dot DT2 is "0", the value of the first dot DT1 is "116", and a value of the dot adjacent to the first direction DR1 of the second dot DT2 is '116'. Therefore, when Equation 1 is applied with the second dot DT2 as the discrimination target dot, the edge value of the second dot DT2 becomes "0" by the following Equation 4.

$$116*(-1)+0*0+116*1=0 \qquad \text{Equation 4}$$

According to one exemplary embodiment, when the edge value of the discrimination target dot is equal to or greater than the threshold value, the first dot detection unit 110 can determine that the discrimination target dot corresponds to the edge dot, and output the first detection signal DS.

For example, the threshold value can be predetermined as 70% of the maximum value of the dot value. In this case, if the maximum value of the dot value is 255, the threshold value becomes 178. Referring to Equations 2, 3 and 4, the absolute value of the edge value of only the first dot DT1 of the dots DT3, DT1, and DT2 exceeds 178. Therefore, the first dot detection unit 110 can output the first detection signal 1DS only for the first dot DT1 of the dots DT3, DT1, and DT2.

The Prewitt mask of a single row may be set as the following Equation 5.

$$[1\ 0\ -1] \qquad \text{Equation 5}$$

The sign of the calculated edge value of the mask of Equation 5 can be reversed to that of the mask of Equation 1.

In another exemplary embodiment, the first dot detection unit 110 may calculate the edge value of the discrimination target dot using a Prewitt mask or a Sobel mask of a plurality of rows in which the first direction DR1 is the row direction and the second direction DR2 is the column direction.

For example, the Prewitt mask of the plurality of rows may correspond to Equation 6 or 7.

$$\begin{bmatrix} -1 & 0 & 1 \\ -1 & 0 & 1 \\ -1 & 0 & 1 \end{bmatrix} \qquad \text{Equation 6}$$

$$\begin{bmatrix} 1 & 0 & -1 \\ 1 & 0 & -1 \\ 1 & 0 & -1 \end{bmatrix} \qquad \text{Equation 7}$$

According to Equations 6 and 7, when calculating the edge value of the first dot DT1, three dots in the previous row and three dots in the next row of the first, second, and third dots DT1, DT2, and DT3 are further considered. The calculation method is similar to the case of using the Prewitt mask of the single row, and therefore a duplicate description thereof will be omitted.

For example, a Sobel mask of a plurality of rows may correspond to Equation 8 or 9.

$$\begin{bmatrix} -1 & 0 & 1 \\ -2 & 0 & 2 \\ -1 & 0 & 1 \end{bmatrix} \qquad \text{Equation 8}$$

$$\begin{bmatrix} 1 & 0 & -1 \\ 2 & 0 & -2 \\ 1 & 0 & -1 \end{bmatrix} \qquad \text{Equation 9}$$

The calculation method is similar to the case of using the Prewitt mask of the plurality of rows, and thus, a description thereof will not be repeated.

The first dot conversion unit 120 may convert the first grayscale value G11 into a first corrected grayscale value G11' and may convert the second grayscale value G12 into a second corrected grayscale value G12' when the first detection signal 1DS is inputted.

In one exemplary embodiment, the first dot conversion unit 120 may generate the first corrected grayscale value G11' and the second corrected grayscale value G12', which are equal to each other.

For example, the first dot conversion unit 120 may set the average value of the first grayscale value G11 and the second grayscale value G12 as the first corrected grayscale value G11' and the second corrected grayscale value G12'. That is, when the first grayscale value G11 is "200" and the second grayscale value G12 is "100" in the second image frame IMF2, the first corrected grayscale value G11' for the first pixel PX1 can be set to "150" and the second corrected grayscale value G12' for the second pixel PX2 can be set to "150" in a third image frame IMF3 corrected.

The data driver 12 supplies a first data voltage corresponding to the first corrected grayscale value G11' to the first pixel PX1, a second data voltage corresponding to the second corrected grayscale value G12' to the second pixel PX2, and a third data voltage corresponding to the third grayscale value G13 to the third pixel PX3.

Unlike the second image frame IMF2 of FIG. 10, since the grayscale values in the third image frame IMF3 of FIG. 12 sequentially fall along the first direction DR1, the anti-aliasing effect can be obtained even in the S-stripe structure. That is, even if the processor 9 provides the second image frame IMF2 for the anti-aliasing font regardless of the structure of the pixel unit 14 of the display device 10, the second image frame IMF2 is corrected at the display device 10 to generate the third image frame IMF3. Therefore the anti-aliasing effect can be obtained.

As another example, the first dot conversion unit 120 may set the first corrected grayscale value G11' and the second corrected grayscale value G12' to a value obtained by adding a value obtained by applying a first weight value wr to the first grayscale value G11 and a value obtained by applying a second weight value wg to the second grayscale value G12.

For example, the first corrected grayscale value G11' and the second corrected grayscale value G12' which are equal to each other can be calculated by the following Equations 10 and 11.

$$G11' = wr * G11 + wg * G12 \qquad \text{Equation 10}$$

$$G12' = wr * G11 + wg * G12 \qquad \text{Equation 11}$$

At this time, when the luminance of the first pixel PX1 is lower than the luminance of the second pixel PX2 with respect to the same grayscale value, the first weight value wr may be less than the second weight value wg. Conversely, when the luminance of the first pixel PX1 is higher than the luminance of the second pixel PX2 with respect to the same grayscale value, the first weight value wr may be larger than the second weight value wg. That is, according to Equations 10 and 11, when setting the first corrected grayscale value G11' and the second corrected grayscale value G12', the grayscale value of a pixel having a low luminance contribution rate can be reflected as a small value and the grayscale value of a pixel having a large luminance contribution rate can be reflected as a large value.

Figure 13:
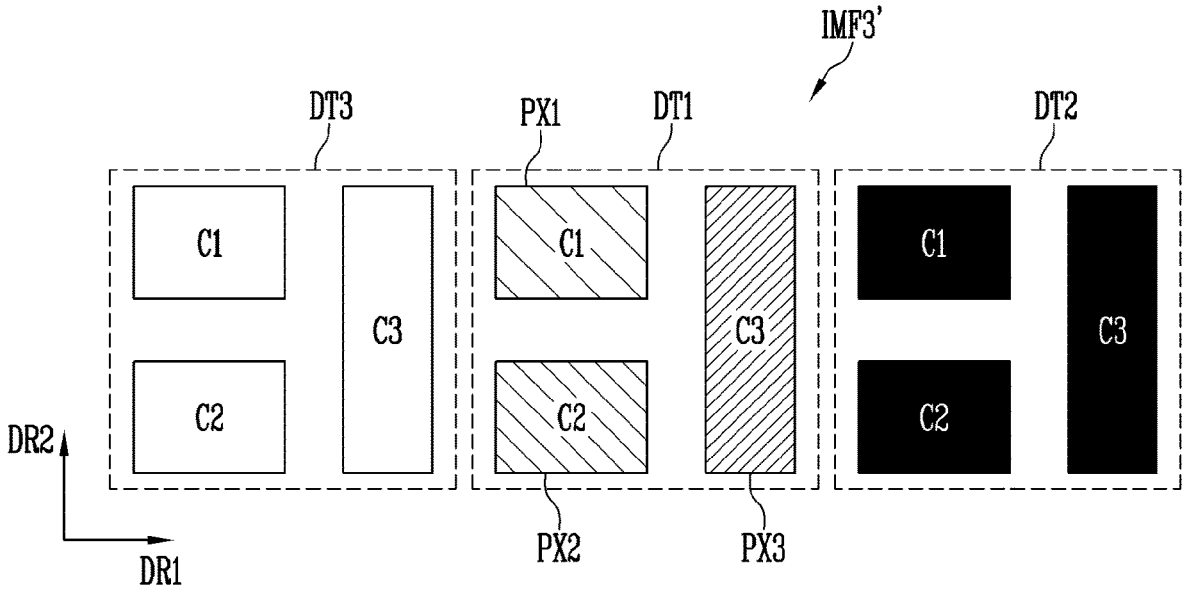
FIG. 13 is a diagram for explaining a third image frame in which a second image frame is corrected differently by the grayscale correction unit of the first exemplary embodiment.

Reference is made to the description of FIG. 13 for the exemplary first and second weight values wr and wg.

FIG. 13 is a diagram for explaining a third image frame IMF3' in which the second image frame is corrected differently by the grayscale correction unit of the first embodiment.

When the third image frame IMF3' of FIG. 13 is compared with the third image frame IMF3 of FIG. 12, the first corrected grayscale value G11' and the second corrected grayscale value G12' may be different from each other.

The first dot conversion unit 120 may generate the first corrected grayscale value G11' and the second corrected grayscale value G12' such that the sum of the first grayscale value G11 and the second grayscale value G12 becomes equal to the sum of the first corrected grayscale value G11' and the second corrected grayscale value G12'. At this time, the first corrected grayscale value G11' and the second corrected grayscale value G12' may be different from each other.

For example, when the luminance of the first pixel PX1 is configured to be lower than the luminance of the second pixel PX2 with respect to the same grayscale value, the first corrected grayscale value G11' may be higher than the second corrected grayscale value G12'.

Referring to the ITU-R BT.601 standard, since the degrees of contribution of red, green, and blue to the luminance are different from each other despite the same grayscale value, the following Equation 12 is established.

$$Y=wr*R+wg*G+wb*B, \text{ where } wr=0.299,\ wg=0.587,\ wb=0.114 \quad \text{Equation 12}$$

Here, Y is the luminance, R is the grayscale value of the red pixel, G is the grayscale value of the green pixel, B is the grayscale value of the blue pixel, and wr, wg and wb are the weight values of the respective colors. That is, with respect to the same grayscale value, the green pixel may be the brightest and the blue pixel may be the darkest.

Therefore, when the first pixel PX1 is the red pixel and the second pixel PX2 is the green pixel, the luminance of the first pixel PX1 may be lower than the luminance of the second pixel PX2 with respect to the same grayscale value. In this case, by making the first corrected grayscale value G11' higher than the second corrected grayscale value G12', the luminance level of the first pixel PX1 and the luminance level of the second pixel PX2 can be substantially equalized.

On the other hand, when the luminance of the second pixel PX2 is configured to be lower than the luminance of the first pixel PX1 with respect to the same grayscale value, the second corrected grayscale value G12' can be greater than the first corrected grayscale value G11'.

Therefore, when the first pixel PX1 is the green pixel and the second pixel PX2 is the red pixel, the luminance of the second pixel PX2 may be lower than the luminance of the first pixel PX1 with respect to the same grayscale value. In this case, by making the second corrected grayscale value G12' greater than the first corrected grayscale value G11', the luminance level of the first pixel PX1 and the luminance level of the second pixel PX2 can be substantially equalized.

In another exemplary embodiment, the first dot conversion unit 120 may calculate a first final corrected grayscale value G11_f and a second final corrected grayscale value G12_f as shown in following Equations 13 and 14 using the first corrected grayscale value G11' and the second corrected grayscale value G12' obtained by Equations 10 and 11.

$$G11_f=G11'/(wr*2) \quad \text{Equation 13}$$

$$G12_f=G12'/(wg*2) \quad \text{Equation 14}$$

According to Equations 13 and 14, when the luminance of the first pixel PX1 is configured to be lower than the luminance of the second pixel PX2 with respect to the same grayscale value, the first final corrected grayscale value G11_f can be greater than the second final corrected grayscale value G12_f. On the other hand, when the luminance of the second pixel PX2 is configured to be lower than the luminance of the first pixel PX1 with respect to the same grayscale value, the second final corrected grayscale value G12_f can be greater than the first final corrected grayscale value G11_f.

Figure 14:
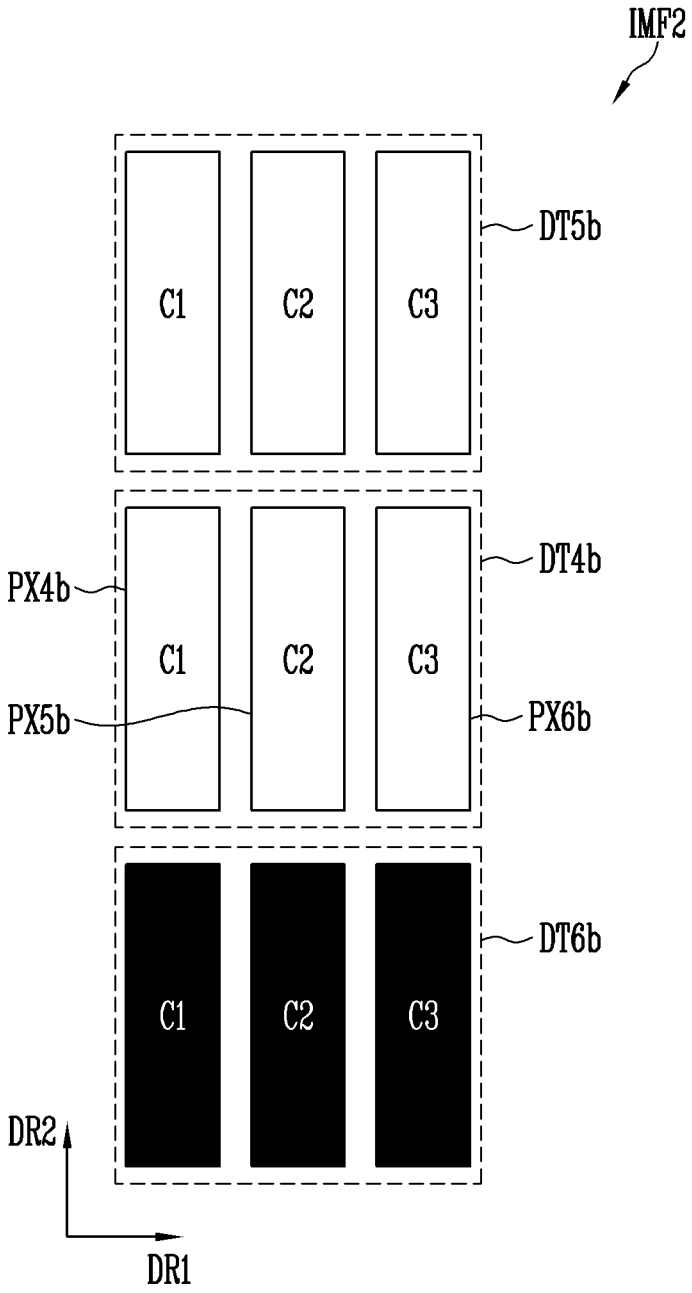
FIG. 14 is an enlarged view of fourth to sixth dots of FIG. 8.

FIG. 14 is an enlarged view of the fourth to sixth dots of FIG. 8.

Referring to FIGS. 8 and 14, the fifth dot DT5*b* is adjacent to the fourth dot DT4*b* in the second direction DR2. The sixth dot DT6*b* is adjacent to the fourth dot DT4*b* in the direction opposite to the second direction DR2.

In the second image frame IMF2, the fifth dot DT5*b* and the fourth dot DT4*b* display a white color which does not constitute a character and the sixth dot DT6*b* display a black color which constitutes the character. The grayscale values of the pixels of the fifth dot DT5*b* may all be "255", and thus, the value of the fifth dot DT5*b* may be "255". The grayscale values of the fourth pixel DT4*b*, the fifth pixel DT5*b*, and the sixth pixel DT6*b* of the fourth dot DT4*b* may all be "255", and thus, the value of the fourth dot DT4*b* may be "255". The grayscale values of the pixels of the sixth dot DT6*b* may all be "0", and thus, the value of the sixth dot DT6*b* may be '0'.

In the second image frame IMF2, the fourth dot DT4*b* is adjacent to the sixth dot DT6*b* corresponding to the edge of the character. Since the pixels PX4, PX5 and PX6 of the fourth dot DT4*b* are adjacent to the sixth dot DT6*b* in the second direction DR2 at the same or similar rate with respect to the first direction DR1, there is no particular problem in displaying the second image frame IMF2 in the RGB-stripe structure.

Figure 15:
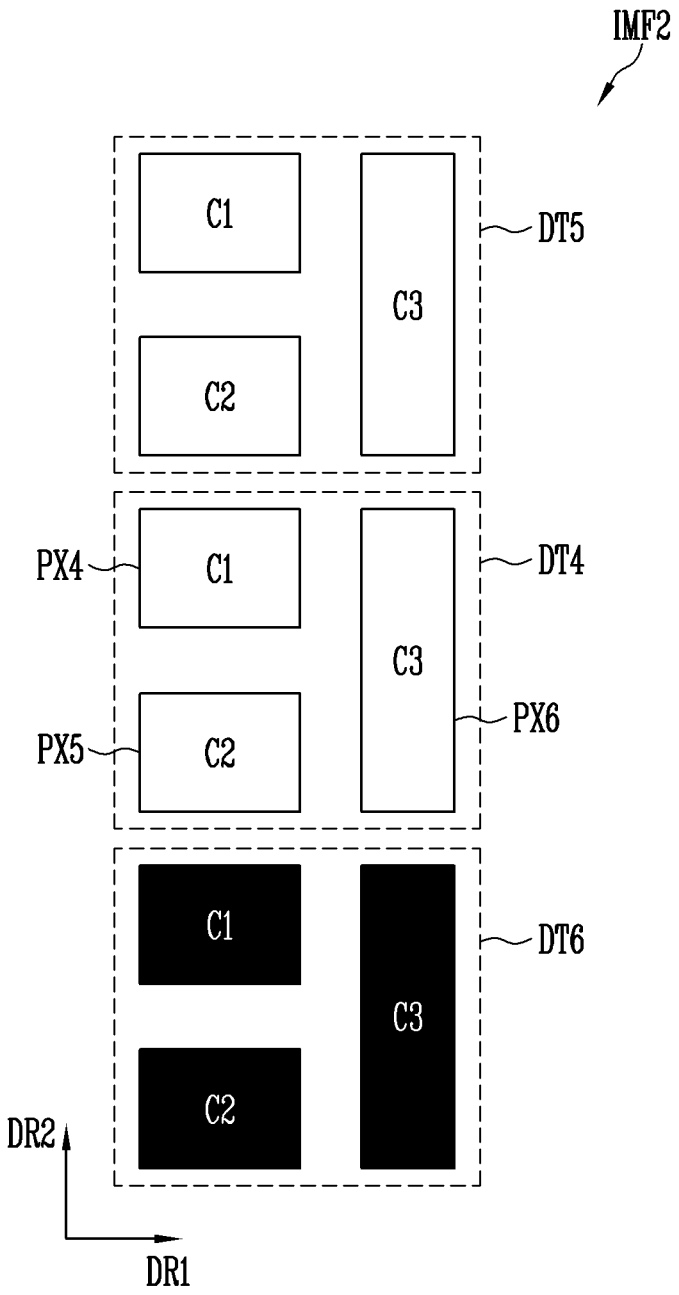
FIG. 15 is a diagram for explaining a case where a second image frame is displayed without correction in the S-stripe structure.

FIG. 15 is a diagram for explaining a case where a second image frame is displayed without correction in the S-stripe structure.

A case where the second image frame IMF2 is displayed in the pixel unit 14 of the display device 10 of FIG. 1 will be described with reference to FIG. 15.

In the pixel unit 14, the fifth dot DT5 is adjacent to the fourth dot DT4 in the second direction DR2 and the sixth dot DT6 is adjacent to the fourth dot DT4 in the direction opposite to the second direction DR2.

The fourth dot DT4 may include the fourth pixel PX4, the fifth pixel PX5 and the sixth pixel PX6. The sixth pixel PX6 may be located in the first direction DR1 from the fourth pixel PX4 and the fifth pixel PX6. The fourth pixel PX4 may be located in the second direction DR2 from the fifth pixel PX5.

In the second image frame IMF2, the fifth dot DT5 and the fourth dot DT4 display a white color which does not constitute a character and the sixth dot DT6 display a black color which constitutes the character. The grayscale values of the pixels of the fifth dot DT5 may all be "255", and thus, the value of the fifth dot DT5 may be "255". The grayscale values of the fourth pixel PX4, the fifth pixel PX5, and the sixth pixel PX6 of the fourth dot DT4 may all be "255", and thus the value of the fourth dot DT4 may be "255". The grayscale values of the pixels of the sixth dot DT6 may all be "0", and thus the value of the sixth dot DT6 may be "0".

Unlike the case of FIG. 14, the distance between the fourth pixel PX4 and the sixth dot DT6 and the distance between the fifth pixel PX5 and the sixth dot DT6 are different from each other. That is, the distance between the fifth pixel PX5 and the sixth dot DT6 is shorter than the distance between the fourth pixel PX4 and the sixth dot DT6. Therefore, the user may view a stripe pattern in which the second color C2 of the fifth pixel PX5 extends in the first direction DR1 from the upper edge of the character (color fringing problem).

On the other hand, referring to FIG. 8, in the fourth dot of the pixel unit 14 corresponding to the fourth dot DT4*b*', the distance between the fourth pixel and the sixth dot is shorter than the distance between the fifth pixel and the sixth dot. Therefore, the user may view a stripe pattern in which the first color C1 of the fourth pixel extends in the first direction DR1 from the lower edge of the character.

Figure 16:
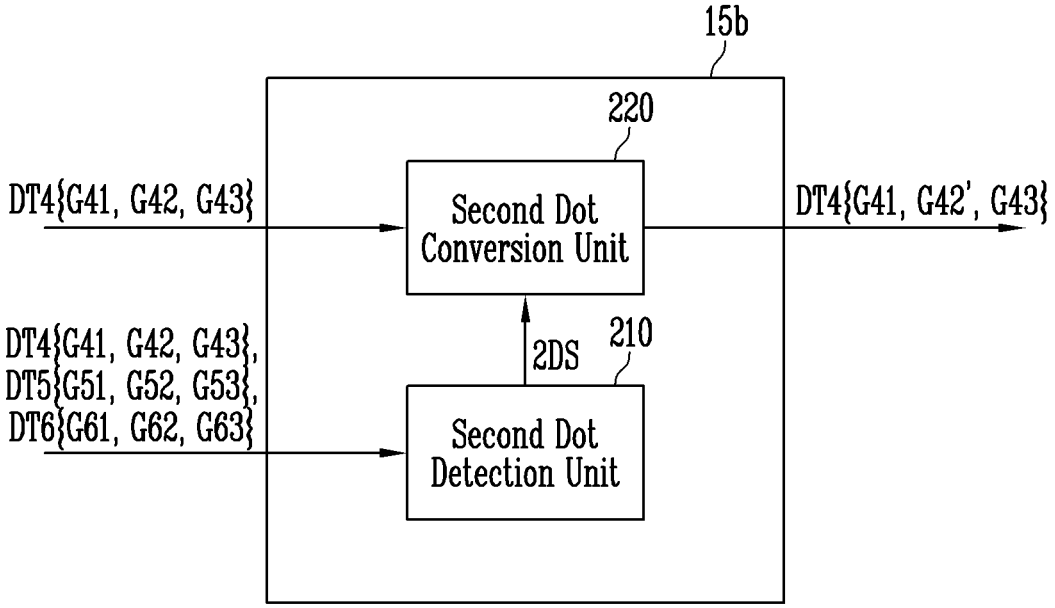
FIG. 16 is a block diagram for explaining a grayscale correction unit according to a second exemplary embodiment of the invention.
Figure 17:
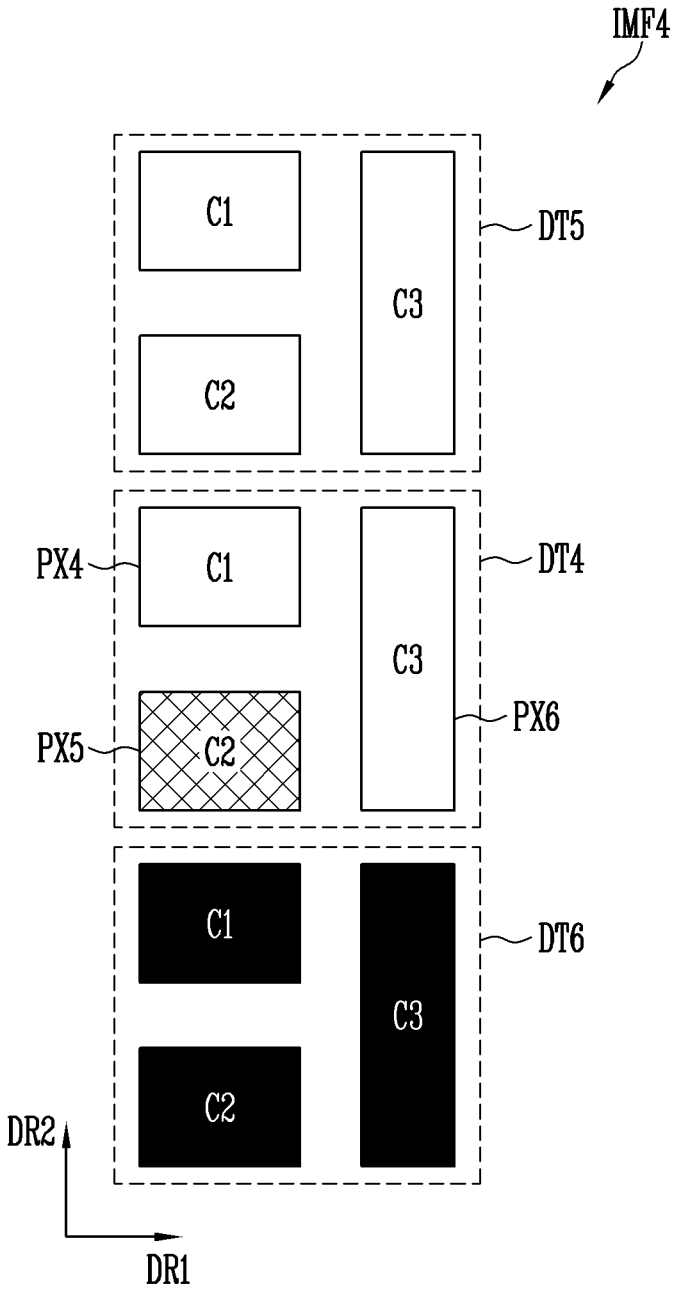
FIG. 17 is a diagram for explaining a fourth image frame in which the second image frame is corrected by the grayscale correction unit of the second exemplary embodiment of the invention.

FIG. 16 is a block diagram for explaining a grayscale correction unit 15*b* according to a second exemplary embodiment of the invention and FIG. 17 is a diagram for explaining a fourth image frame IMF4 in which the second image frame is corrected by the grayscale correction unit 15*b* of the second exemplary embodiment of the invention.

Referring to FIG. 16, the grayscale correction unit 15*b* of the second exemplary embodiment may include a second dot detection unit 210 and a second dot conversion unit 220.

The second dot detection unit 210 may output a second detection signal 2DS based on grayscale values G41, G42, G43, G51, G52, G53, G61, G62, and G63 of the fourth, fifth, and sixth dots DT4, DT5, and DT6 when the fourth dot DT4 is determined as a dot adjacent to the edge of the object included in the second image frame IMF2.

For example, the second dot detection unit 210 may output the second detection signal 2DS based on the grayscale values G41, G42, G43, G51, G52, G53, G61, G62, and G63 of the fourth, fifth, and sixth dots DT4, DT5, and DT6 when an edge value of the fourth dot DT4 is equal to or greater than the threshold value.

According to one exemplary embodiment, the second dot detection unit 210 may calculate the edge value of the fourth dot DT4 by applying a Prewitt mask of a single column in which the second direction DR2 is the column direction to the fourth, fifth, and sixth dots DT4, DT5, and DT6. For example, the Prewitt mask of the single column may correspond to the following Equation 15.

$$\begin{bmatrix} 1 \\ 0 \\ -1 \end{bmatrix} \qquad \text{Equation 15}$$

In Equation 15, "0" in the second row and the first column can be multiplied by the value of the discrimination target dot, "1" in the first row and the first column can be multiplied by the value of the dot adjacent to the discrimination target dot in the second direction DR2, and "−1" in the third row and the first column can be multiplied by the value of a dot adjacent to the direction opposite to the second direction DR2 of the discrimination target dot. The sum of the multiplied values may correspond to the edge value of the discrimination target dot. Here, when the edge value is a negative number, it means that the grayscale value falls in the second direction DR2 with the discrimination target dot as a boundary. Also, when the edge value is a positive number, it means that the grayscale value rises in the second direction DR2 with the discrimination target dot as a boundary.

For example, a case where the fifth dot DT5 corresponds to the discrimination target dot will be described referring to FIGS. 8, 14, and 15. A value of the fifth dot DT5 is "255", a value of a dot located in the second direction DR2 of the fifth dot DT5 is "255", and a value of the fourth dot DT4 is "255". Therefore, when the fifth dot DT5 as the discrimination target dot is applied to Equation 15, the edge value of the fifth dot DT5 becomes "0".

For example, a case where the fourth dot DT4 corresponds to the discrimination target dot will be described referring to FIGS. 8, 14, and 15. The value of the fourth dot DT4 is "255", the value of the fifth dot DT5 is "255", and the value of the sixth dot DT6 is "0". Therefore, when Equation 15 is applied with the fourth dot DT4 as the discrimination target dot, the edge value of the fourth dot DT4 becomes "255".

In addition, for example, a case where the sixth dot DT6 corresponds to the discrimination target dot will be described referring to FIGS. 8, 14, and 15. The value of the sixth dot DT6 is "0", the value of the fourth dot DT4 is "255", and a value of a dot adjacent to the sixth dot DT6 in the direction opposite to the second direction DR2 is "255". Therefore, when the sixth dot DT6 as the discrimination target dot is applied to Equation 15, the edge value of the sixth dot DT6 becomes "0".

According to one exemplary embodiment, the second dot detection unit 210 may output the second detection signal 2DS by discriminating that the discrimination target dot corresponds to the dot adjacent to the edge of the object when the edge value of the discrimination target dot is equal to or greater than the threshold value.

For example, the threshold value can be predetermined as 70% of the maximum value of the dot value. In this case, if the maximum value of the dot value is 255, the threshold value becomes 178. Only the fourth dot DT4 among the dots DT4, DT5 and DT6 has an absolute value of the edge value exceeding 178. Therefore, the second dot detection unit 210 may output the second detection signal 2DS only to the fourth dot DT4 among the dots DT4, DT5, and DT6.

According to one exemplary embodiment, the second detection signal 2DS may include the sign of the edge value as information.

The mask of Equation 15 can be modified as in Equations 5, 6, 7, 8, and 9. Duplicate descriptions are omitted.

When the second detection signal 2DS is inputted, the second dot conversion unit 220 may select one of the fourth grayscale value G41 corresponding to the fourth pixel PX4 and the fifth grayscale value G42 corresponding to the fifth pixel PX5 based on the second detection signal 2DS and may generate a third corrected grayscale value by decreasing a selected grayscale value.

As described above, the second detection signal 2DS may include the sign of the edge value as information. For example, when the mask of Equation 15 is used as described above, when the edge value is a negative number, it means that the grayscale value falls in the second direction DR2 with the discrimination target dot as a boundary. In addition, when the edge value is a positive number, it means that the grayscale value rises in the second direction DR2 with the discrimination target dot as a boundary.

The edge value of the fourth dot DT4 described above is "255", which is a positive number. Accordingly, the second dot conversion unit 220 can recognize that the boundary area between the fourth dot DT4 and the sixth dot DT6 is the edge of the object, based on the second detection signal 2DS. In this case, the second dot conversion unit 220 may select the fifth grayscale value G42 corresponding to the fifth pixel PX5 and may generate a third corrected grayscale value G42' by decreasing the fifth grayscale value G42. When the second dot conversion unit 220 generates the third corrected grayscale value G42' by decreasing the fifth grayscale value G42, the data driver 12 may supply a data voltage corresponding to the third corrected grayscale value G42' to the fifth pixel PX5.

For example, the third corrected grayscale value G42' may be obtained by decreasing the selected fifth grayscale value G42 by 20%. The amount of decrease can be specified differently according to the specifications of the display device 10.

Comparing the case where the second image frame IMF2 of FIG. 15 is applied to the pixel unit 14 and the case where the fourth image frame IMF4 of FIG. 17 is applied to the pixel unit 14, it can be confirmed that the color fringing problem by the fifth pixel PX5 in the S-strip structure can be alleviated.

Referring to the dots DT4*b*', DT5*b*', and DT6*b*' in FIG. 8, the second dot detection unit 210 may output the second detection signal 2DS having information that the edge value is a negative number for the fourth to sixth dots when the discrimination target dot is the fourth dot. Therefore, the second dot conversion unit 220 can recognize that the boundary area between the fourth dot and the fifth dot is the edge of the object based on the second detection signal 2DS. In this case, the second dot conversion unit 220 may select the fourth grayscale value corresponding to the fourth pixel and may generate the third corrected grayscale value by decreasing the fourth grayscale value. When the second dot conversion unit 220 generates the third corrected grayscale value by decreasing the fourth grayscale value, the data driver 12 may supply the data voltage corresponding to the third corrected grayscale value to the fourth pixel.

Figure 18:
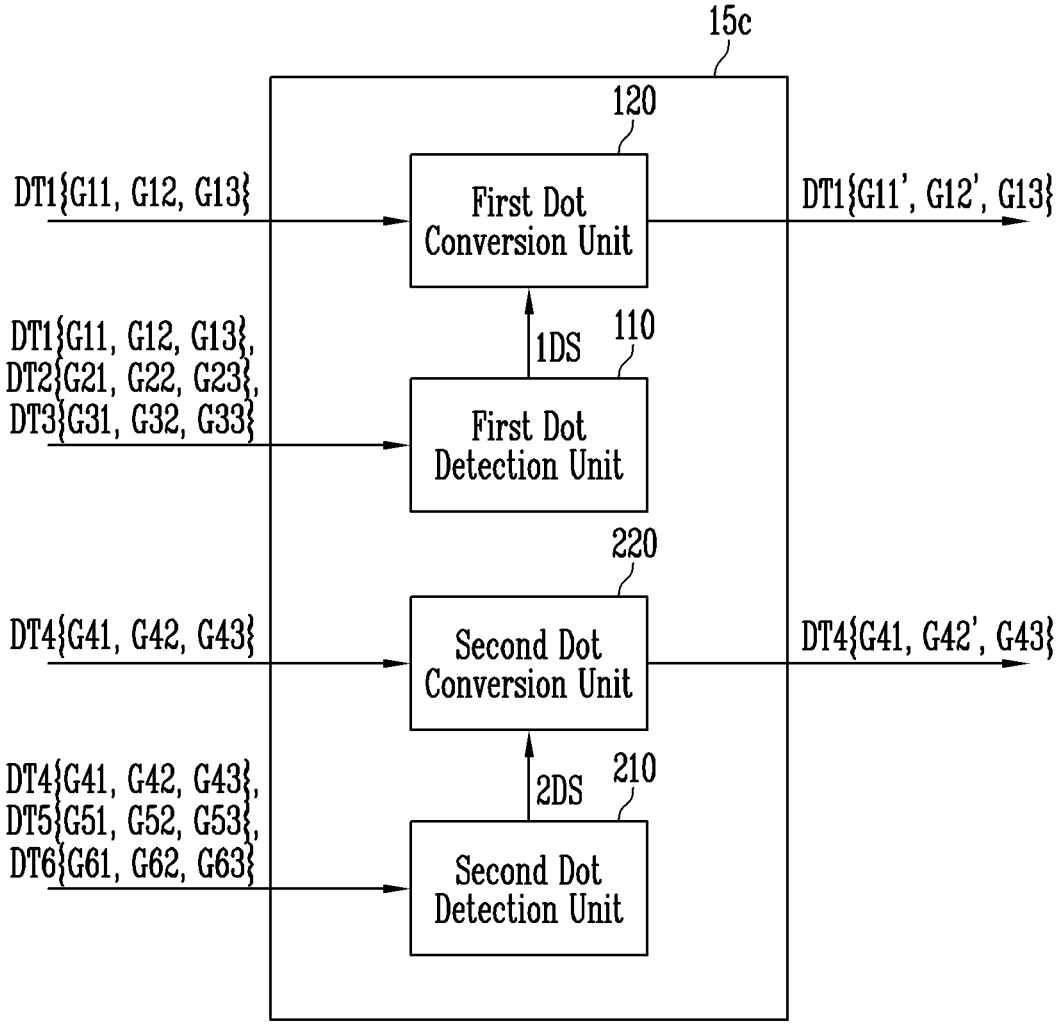
FIG. 18 is a block diagram for explaining a grayscale correction unit according to a third exemplary embodiment of the invention.

FIG. 18 is a block diagram for explaining a grayscale correction unit 15*c* according to a third exemplary embodiment of the invention.

The grayscale correction unit 15*c* in FIG. 18 includes the grayscale correction unit 15*a* in FIG. 11 and the grayscale correction unit 15*b* in FIG. 16.

In this case, it may be a problem whether the correction by the first dot detection unit 110 and the first dot conversion unit 120 or the correction by the second dot detection unit 210 and the second dot conversion unit 220 is initially performed for the second image frame IMF2.

Referring to FIGS. 7 and 8, when the processor 9 constructs the second image frame IMF2 using the anti-aliasing font, a sequential change of the grayscale values in the first direction DR1 can be confirmed.

According to one exemplary embodiment, the correction by the first dot detection unit 110 and the first dot conversion unit 120 is initially performed, so that the correction in the first direction DR1, which is the main direction, can be initially performed. The first direction DR1 may be a direction in which characters are arranged in a sentence.

In another exemplary embodiment, however, when resolution of the color fringing problem is more important than resolution of the aliasing problem, the correction by the second dot detection unit 210 and the second dot conversion unit 220 may be initially performed.

Figure 19:
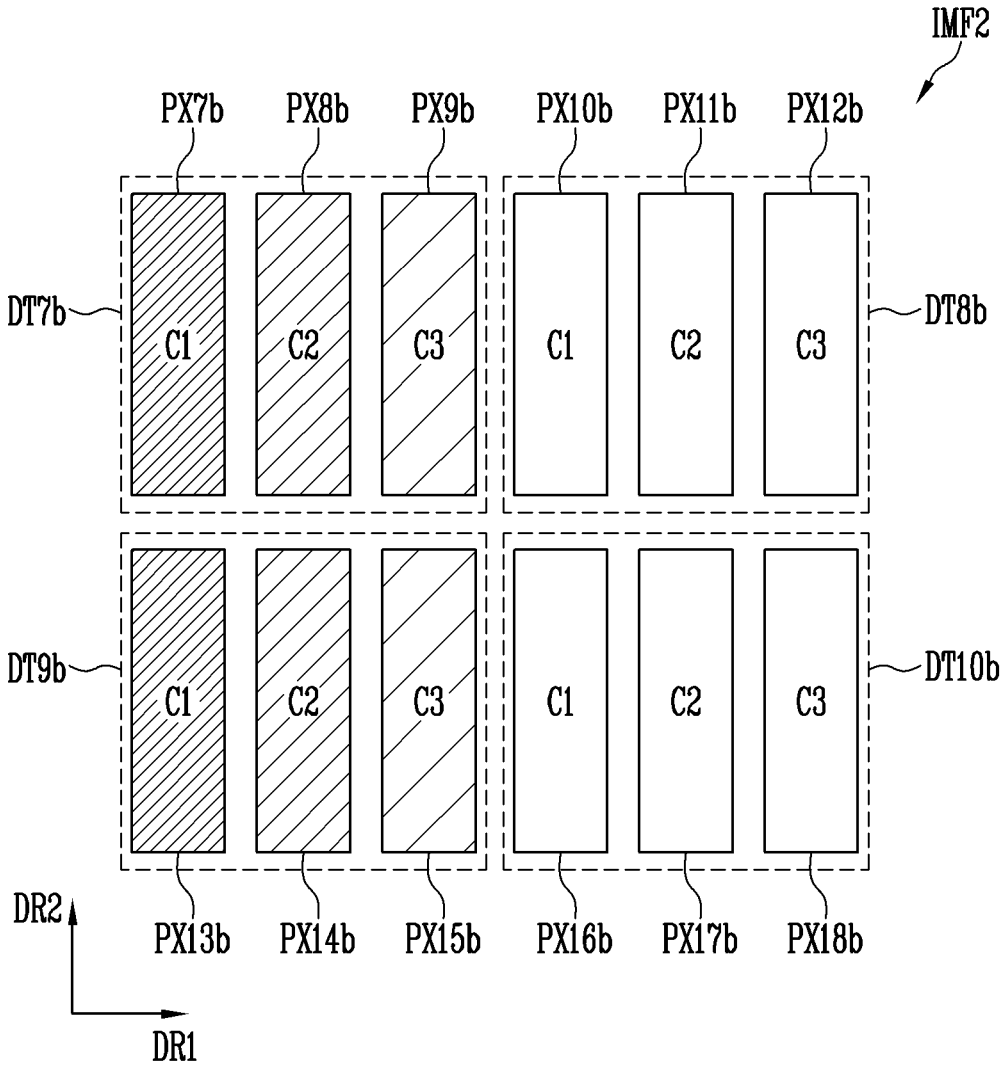
FIG. 19 is an enlarged view of the seventh to tenth dots of FIG. 8.

FIG. 19 is an enlarged view of the seventh to tenth dots of FIG. 8.

The seventh dot DT7*b* may include a seventh pixel PX7*b*, an eighth pixel PX8*b*, and a ninth pixel PX9*b*. For example, the processor 9 may provide a grayscale value of "50" to the seventh pixel PX7*b*, a grayscale value of "100" to the eighth pixel PX8*b*, and a grayscale value of "200" to the ninth pixel PX9*b* in the second image frame IMF2.

The eighth dot DT8*b* may be adjacent to the seventh dot DT7*b* in the first direction DR1 and may include a tenth pixel PX10*b*, an eleventh pixel PX11*b*, and a twelfth pixel PX12*b*. For example, the processor 9 may provide grayscale values of "255" to the tenth pixel PX10*b*, the eleventh pixel PX11*b*, and the twelfth pixel PX12*b* in the second image frame IMF2.

A ninth dot DT9*b* may be adjacent to the seventh dot DT7*b* in the direction opposite to the second direction DR2 and may include a thirteenth pixel PX13*b*, a fourteenth pixel PX14*b*, a fifteenth pixel PX15*b*. For example, the processor 9 may provide a grayscale value of "50" to the thirteenth pixel PX13*b*, a grayscale value of "100" to the fourteenth pixel PX14*b*, and a grayscale value of "200" to the fifteenth pixel PX15*b* in the second image frame IMF2.

The tenth dot DT10*b* may be adjacent to the ninth dot DT9*b* in the first direction DR1 and may include a sixteenth pixel PX16*b*, a seventeenth pixel PX17*b*, and an eighteenth pixel PX18*b*. For example, the processor 9 may provide the grayscale values of "255" to the sixteenth pixel PX16*b*, the seventeenth pixel PX17*b*, and the eighteenth pixel PX18*b* in the second image frame IMF2.

In the RGB-stripe structure of FIG. 19, the luminance change sequentially occurs in the first direction DR1 and the luminance is maintained constantly in the second direction DR2, so that the anti-aliasing effect can be exhibited.

Figure 20:
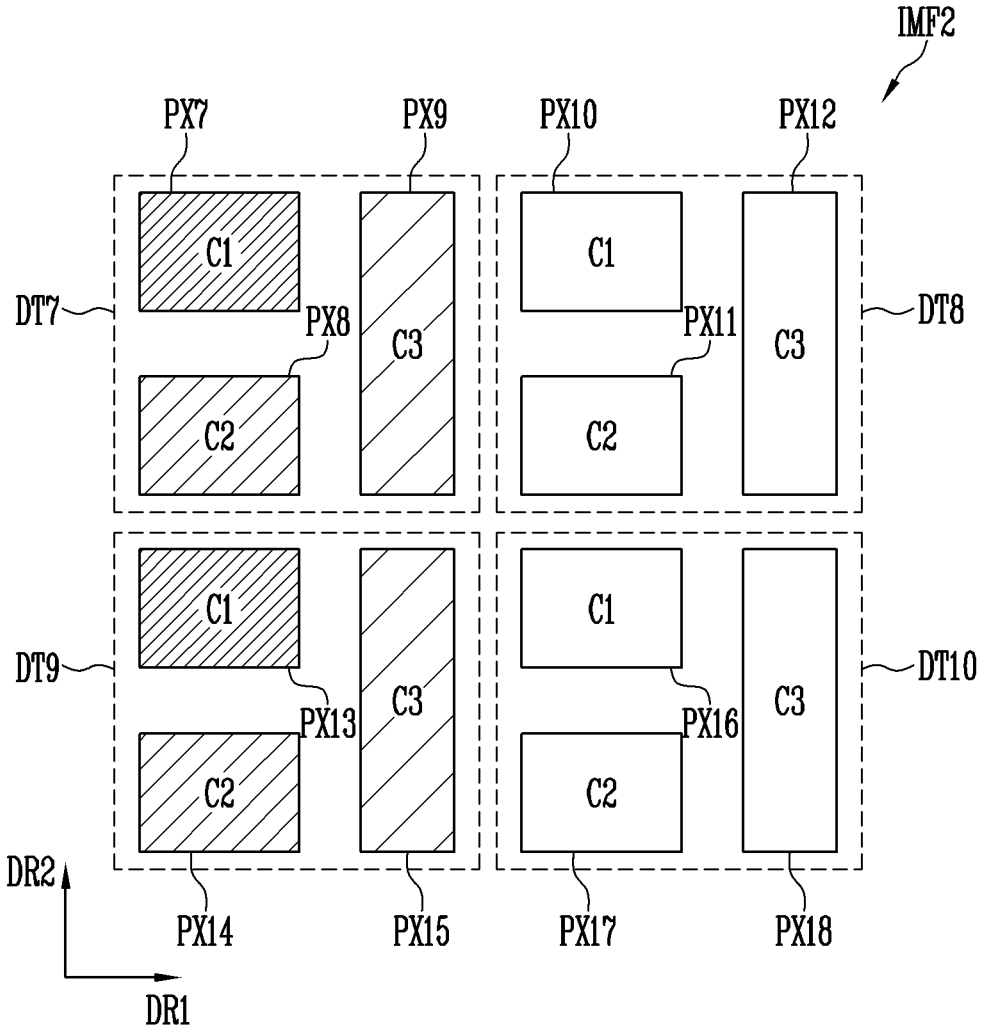
FIG. 20 is a diagram for explaining a case where a second image frame is displayed without correction in the S-stripe structure.

FIG. 20 is a diagram for explaining a case where the second image frame is displayed without correction in the S-stripe structure.

The seventh dot DT7 may include the seventh pixel PX7, the eighth pixel PX8, and the ninth pixel PX9. The ninth pixel PX9 may be located in the first direction DR1 from the seventh pixel PX7 and the eighth pixel PX8 and the seventh pixel PX7 may be located in the second direction DR2 from the eighth pixel PX8.

The eighth dot DT8 may be adjacent to the seventh dot DT7 in the first direction DR1 and may include the tenth pixel PX10, the eleventh pixel PX11, and the twelfth pixel PX12. The twelfth pixel PX12 may be located in the first direction DR1 from the tenth pixel PX10 and the eleventh pixel PX11 and the tenth pixel PX10 may be located in the second direction DR2 from the eleventh pixel PX11.

The ninth dot DT9 may be adjacent to the seventh dot DT7 in the direction opposite to the second direction DR2 and may include the thirteenth pixel PX13, the fourteenth pixel PX14, and the fifteenth pixel PX15. The fifteenth pixel PX15 may be located in the first direction DR1 from the thirteenth pixel PX13 and the fourteenth pixel PX14 and the thirteenth pixel PX13 may be located in the second direction DR2 from the fourteenth pixel PX14.

The tenth dot DT10 may be adjacent to the ninth dot DT9 in the first direction DR1 and may include the sixteenth pixel PX16, the seventeenth pixel PX17, and the eighteenth pixel PX18. The eighteenth pixel PX18 may be located in the first direction DR1 from the sixteenth pixel PX16 and the seventeenth pixel PX17 and the sixteenth pixel PX16 may be located in the second direction DR2 from the seventeenth pixel PX17.

In the S-stripe structure of FIG. 20, when the grayscale values of the second image frame IMF2 are applied without correction, the luminance changes irregularly in the first direction DR1 and/or the second direction DR2, so that the anti-aliasing effect cannot work properly.

In addition, in the eighth pixel PX8 and the fourteenth pixel PX14 in which the grayscale values of "100" are provided as compared with the seventh pixel PX7 and the fourteenth pixel PX13 in which the grayscale values of "50" are provided, the color fringing phenomenon for the second color C2 may occur. This color fringing phenomenon may occur more strongly when the luminance of the second color C2 is higher than the luminance of the first color C1 for the same grayscale value. For example, the second color C2 may be green and the first color C1 may be red.

Figure 21:
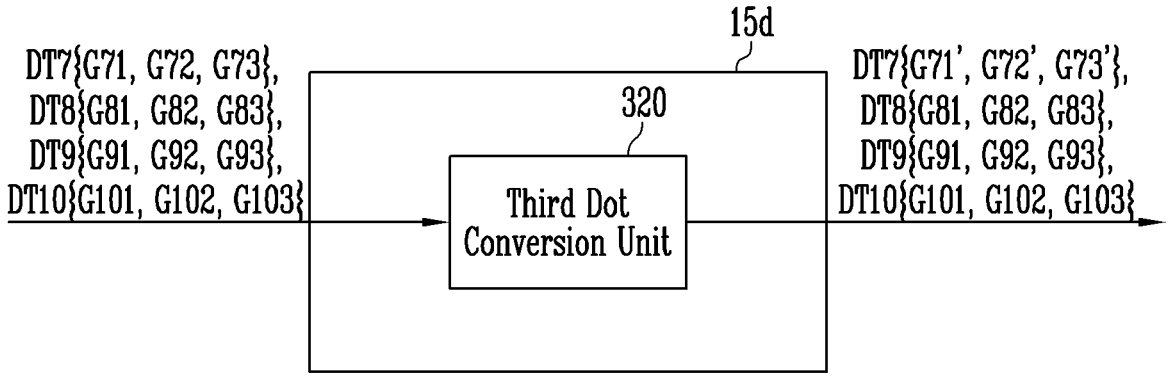
FIG. 21 is a block diagram for explaining a grayscale correction unit according to a fourth exemplary embodiment of the invention.
Figure 22:
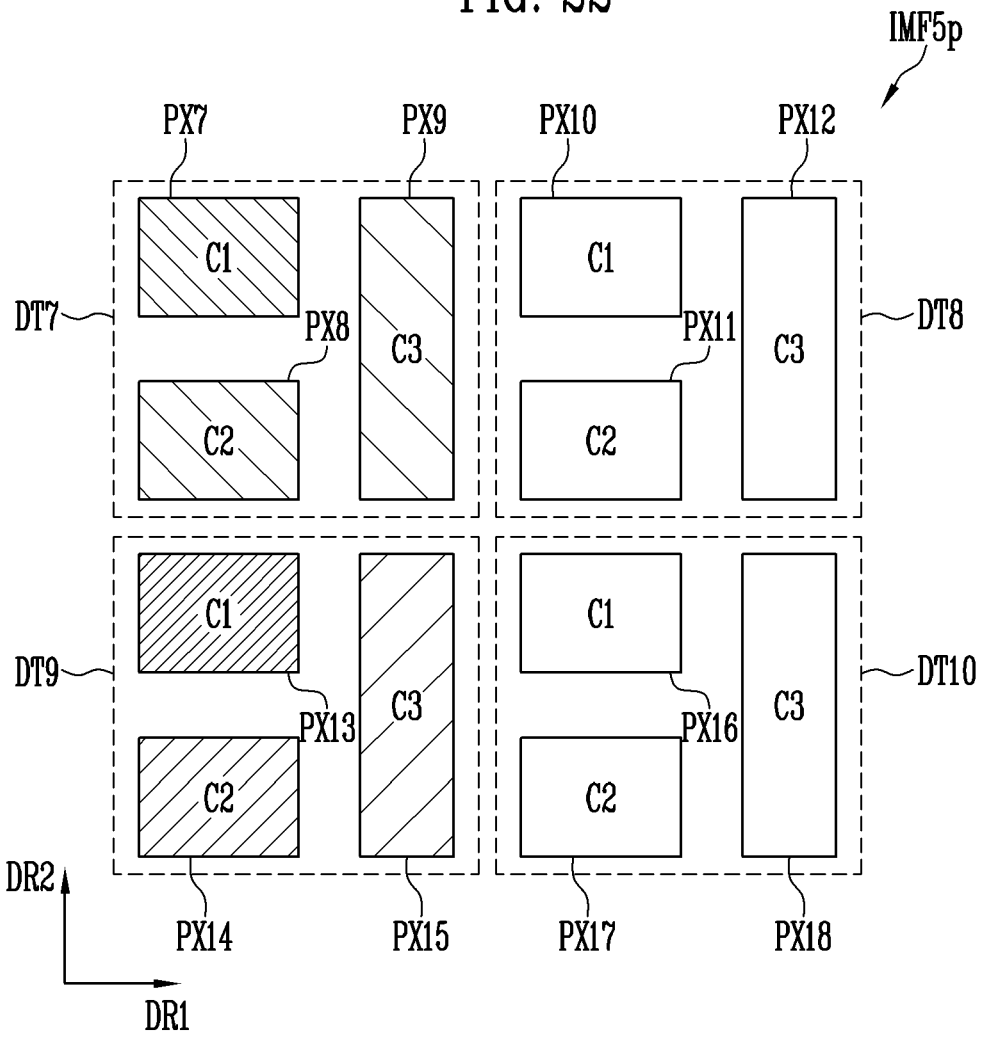
FIG. 22 is a diagram for explaining a fifth image frame in which the second image frame is partially corrected by the grayscale correction unit of the fourth embodiment.

FIG. 21 is a block diagram for explaining a grayscale correction unit 15*d* according to a fourth exemplary embodiment of the invention, and FIG. 22 is a diagram for explaining a fifth image frame IMF5 in which the second image frame is partially corrected by the grayscale correction unit of the fourth exemplary embodiment.

Referring to FIG. 21, the grayscale correction unit 15*d* may include a third dot conversion unit 320. The grayscale correction unit 15*d* and the third dot conversion unit 320 may refer to the same components.

Unlike the other exemplary embodiments, the grayscale correction unit 15*d* may not include a separate dot detection unit. That is, the grayscale correction unit 15*d* of the fourth embodiment may perform grayscale correction on all the dots without the process for detecting the edge dot. However, the grayscale correction may not be applied to some outermost dots to which the following Equations cannot be applied.

The grayscale correction unit 15*d* may generate corrected grayscale values G71', G72', and G73' for colors C1, C2, and C3, respectively, of the seventh dot DT7 based on grayscale values G71, G72, G73, G81, G82, G83, G91, G92, G93, G101, G102, and G103 for the same colors of the eighth, ninth, and tenth dots DT8, DT9, and DT10.

The grayscale correction unit 15*d* may generate a fourth corrected grayscale value G71' for the first color C1 based on the grayscale values G71, G81, G91, and G101 of the seventh pixel PX7, the tenth pixel PX10, the thirteenth pixel PX13, and the sixteenth pixel PX16. The grayscale correction unit 15*d* may generate a fifth corrected grayscale value G72' for the second color C2 based on the grayscale values G72, G82, G92, and G102 of the eighth pixel PX8, the eleventh pixel PX11, the fourteenth pixel PX14, and the seventeenth pixel PX17. In addition, the grayscale correction unit 15*d* may generate a sixth corrected grayscale value G73' for the third color C3 based on the grayscale values G73, G83, G93, and G103 of the ninth pixel PX9, the twelfth pixel PX12, the fifteenth pixel PX15, and the eighteenth pixel PX18.

The data driver 12 may supply the data voltage corresponding to the fourth corrected grayscale value G71' to the seventh pixel PX7, the data voltage corresponding to the fifth corrected grayscale value G72' to the eighth pixel PX8, and the data voltage corresponding to the sixth corrected grayscale value G73' to the ninth pixel PX9.

For example, the grayscale correction unit 15*d* may generate the fourth, fifth, and sixth corrected grayscale values G71', G72', and G73' for the seventh dot DT7 based on the following Equation 16.

$$\begin{bmatrix} F1 & F2 \\ F3 & F4 \end{bmatrix} \qquad \text{Equation 16}$$

Here, F1 is a weight value to be multiplied by each of the pixels PX7, PX8, and PX9 of the seventh dot DT7, F2 is a weight value to be multiplied by each of the pixels PX10, PX11, and PX12 of the eighth dot DT8, F3 is a weight value to be multiplied by each of the pixels PX13, PX14, and PX15 of the ninth dot DT9, and F4 is a weight value to be multiplied by each of the pixels PX16, PX17, and PX18 of the tenth dot DT10.

According to one exemplary embodiment, in Equation 16, the magnitude of F1 may be greater than those of F2, F3, and F4. That is, the self-grayscale ratio may be relatively large. Therefore, F1 which is the weight value for the grayscale value G71 of the seventh pixel PX7 may be the largest in generating the fourth corrected grayscale value G71', F1 which is the weight value for the grayscale value G72 of the eighth pixel PX8 may be the largest in generating the fifth corrected grayscale value G72', and F1 which is the weight value for the grayscale value G73 of the ninth pixel PX9 may be the largest in generating the sixth corrected grayscale value G73'.

According to one exemplary embodiment, the value obtained by adding F1, F2, F3, and F4 in Equation 16 may be 1. At this time, F1, F2, F3, and F4 can be variably adjusted to about 20% depending on the product. For example, F1 may be set to 0.625, F2 may be set to 0.125, F3 may be set to 0.125, and F4 may be set to 0.125. In addition, F1 is a value in a range from 0.5 to 0.75, F2 is a value in a range from 0.1 to 0.15, F3 is a value in a range from 0.1 to 0.15, and F4 is a value in a range from 0.1 to 0.15, depending on the product.

Those skilled in the art will be able to determine the values of F1, F2, F3, and F4 that are appropriate for the product by appropriately adjusting the exemplified values.

For example, the fourth corrected grayscale value G71' may be calculated as shown in the following Equation 17.

$$0.625*50+0.125*255+0.125*50+0.125*255=101.25 \qquad \text{Equation 17}$$

Here, when digits after the decimal point are discarded, the fourth corrected grayscale value G71' may be "101".

For example, the fifth corrected grayscale value G72' may be calculated as shown in the following Equation 18.

$$0.625*100+0.125*255+0.125*100+0.125*255=138.75 \qquad \text{Equation 18}$$

Here, when digits after the decimal point are discarded, the fifth corrected grayscale value G72' may be "138".

For example, the sixth corrected grayscale value G73' can be calculated as shown in the following Equation 19.

$$0.625*200+0.125*255+0.125*200+0.125*255=213.75 \qquad \text{Equation 19}$$

Here, when digits after the decimal point are discarded, the sixth corrected grayscale value G73' may be "213".

It can be seen that the calculated fourth, fifth, and sixth corrected grayscale values G71', G72', and G73' have a smaller difference than the pre-corrected grayscale values G71, G72, and G73. Therefore, the color fringing problem that occurs in FIG. 20 can be mitigated.

In addition, it can be seen that the calculated fourth, fifth, and sixth corrected grayscale values G71', G72', and G73' are corrected in the high grayscale direction as compared with the pre-corrected grayscale values G71, G72, and G73. Since the human eyes are less sensitive to the change in the high grayscale than the change in the low grayscale, the color fringing problem that occurs in FIG. 20 can be further mitigated.

FIG. 22 shows a fifth partial image frame IMF5*p* to which the corrected grayscale values G71', G72', and G73' are applied to the seventh dot DT7 which is a part of the second image frame IMF2. The same process as described above can be performed by the grayscale correction unit 15*d* for the other dots DT8, DT9, DT10, . . . . The data processed by the grayscale correction unit 15*d* may depend on the data of the second image frame IMF2 provided by the processor 9 and may be independent of the data of the fifth partial image frame IMF5*p* already processed.

According to one exemplary embodiment, the grayscale correction unit 15*d* may set F3 and F4 in Equation 16 to 0 in order to perform correction on the first direction DR1. For example, F1=0.75, F2=0.25, F3=0, and F4=0 may be satisfied.

According to another exemplary embodiment, the grayscale correction unit 15*d* may set F2 and F4 in Equation 16 to 0 in order to perform correction on the second direction DR2. For example, F1=0.75, F2=0, F3=0.25, and F4=0 may be satisfied.

Figure 23:
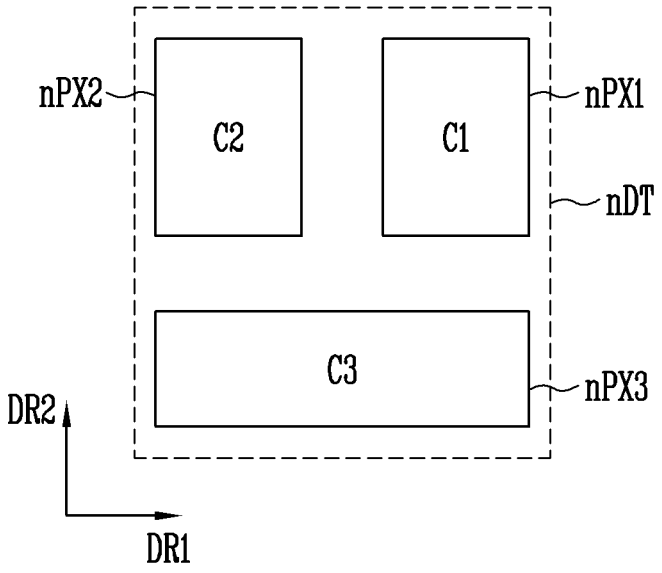
FIG. 23 is a diagram for explaining a case where exemplary embodiments of the invention are applied to the S-stripe structure which is different from what is shown in FIGS. 1 and 4.

FIG. 23 is a diagram for explaining a case where the exemplary embodiments of the invention are applied to the S-stripe structure which is different from FIGS. 1 and 4.

Referring to FIG. 23, a first dot nDT may include a first pixel nPX1, a second pixel nPX2, and a third pixel nPX3. The first pixel nPX1 may be located in the first direction DR1 from the second pixel nPX2 and the first pixel nPX1 and the second pixel nPX2 may be located in the second direction DR2 from the third pixel nPX3.

That is, the first dot nDT of FIG. 23 may be tilted by 90 degrees with respect to the first dot DT1 of FIG. 1.

The case of the exemplary embodiment of FIG. 23 also includes the second dot adjacent to the first dot nDT in the first direction DR1 and the third dot adjacent to the first dot nDT in the direction opposite to the first direction DR1.

All the exemplary embodiments that can be applied to the first dot DT1 of FIG. 1 can be applied to the first dot nDT of FIG. 23.

For example, when the first dot nDT is determined as the edge of the object included in the image frame based on the grayscale values of the first to third dots, the grayscale correction unit may generate the first corrected grayscale value and the second corrected grayscale value based on the first grayscale value corresponding to the first pixel nPX1 and the second grayscale value corresponding to the second pixel nPX2.

The grayscale correction unit may include a first dot detection unit for outputting a first detection signal when the edge value of the first dot nDT calculated based on the grayscale values of the first to third dots is equal to or greater than a threshold value.

In addition, the grayscale correction unit may include a first dot conversion unit. The first dot conversion unit may convert the first grayscale value into the first corrected grayscale value and may convert the second grayscale value into the second corrected grayscale value when the first detection signal is inputted. The first corrected grayscale value and the second corrected grayscale value may be equal to each other.

On the other hand, the grayscale correction unit may include a first dot conversion unit. The first dot conversion unit may convert the first grayscale value into the first corrected grayscale value and may convert the second grayscale value into the second corrected grayscale value when the first detection signal is inputted. The sum of the first grayscale value and the second grayscale value is equal to the sum of the first corrected grayscale value and the second corrected grayscale value.

The case of the exemplary embodiment of FIG. 23 may include the fifth dot adjacent to the fourth dot in the second direction DR2 and the sixth dot adjacent to the fourth dot in the direction opposite to the second direction DR2. The fourth dot may include the fourth pixel, the fifth pixel, and the sixth pixel. The sixth pixel may be located in the first direction DR1 from the fourth pixel and the fifth pixel and the fourth pixel may be located in the second direction DR2 from the fifth pixel.

The grayscale correction unit may include a second dot detection unit for outputting the second detection signal when the fourth dot is determined as a dot adjacent to the edge of the object included in the image frame based on the grayscale values for the fourth to sixth dots.

In addition, the grayscale correction unit may include a second dot conversion unit for generating the third corrected grayscale value. The second dot conversion unit may select one of the fourth grayscale value corresponding to the fourth pixel and the fifth grayscale value corresponding to the fifth pixel based on the second detection signal when the second detection signal is inputted and may generate the third corrected grayscale value by decreasing the selected grayscale value.

At this time, the first corrected grayscale value and the second corrected grayscale value may be equal to each other.

The display device according to the invention can display an image frame in which aliasing is relaxed for various pixel arrangement structures.

Although certain exemplary embodiments have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A display device comprising:

a first dot comprising a first pixel, a second pixel, and a third pixel, wherein the third pixel is located in a first direction from the first pixel and the second pixel and the first pixel is located in a second direction from the second pixel;

a second dot adjacent to the first dot in the first direction;

a third dot adjacent to the first dot in a direction opposite to the first direction;

a timing controller configured to receive grayscale values of the first to third dots for an image frame from an external processor;

a grayscale correction unit configured to generate a first corrected grayscale value based on a first grayscale value corresponding to the first pixel and a second grayscale value corresponding to the second pixel, and generate a second corrected grayscale value based on the first grayscale value and the second grayscale value, when the first dot is determined as an edge of an object included in the image frame based on the grayscale values of the first to third dots; and a data driver configured to supply a first data voltage corresponding to the first corrected grayscale value to the first pixel, supply a second data voltage corresponding to the second corrected grayscale value to the second pixel, and supply a third data voltage corresponding to a third grayscale value to the third pixel.

2. The display device of claim 1, wherein the grayscale correction unit comprises a first dot detection unit configured to output a first detection signal when an edge value of the first dot calculated based on the grayscale values of the first to third dots is equal to or greater than a threshold value.

3. The display device of claim 2, wherein:

the grayscale correction unit further comprises a first dot conversion unit configured to convert the first grayscale value into the first corrected grayscale value and convert the second grayscale value into the second corrected grayscale value when the first detection signal is inputted; and the first corrected grayscale value and the second corrected grayscale value are equal to each other.

4. The display device of claim 3, wherein the first dot conversion unit sets an average value of the first grayscale value and the second grayscale value as the first corrected grayscale value and the second corrected grayscale value.

5. The display device of claim 3, wherein:

a luminance of the first pixel is lower than a luminance of the second pixel with respect to a same grayscale value;

the first dot conversion unit sums a value obtained by applying a first weight value to the first grayscale value and a value obtained by applying a second weight value to the second grayscale value to set the first corrected grayscale value and the second corrected grayscale value as a sum; and the first weight value is less than the second weight value.

6. The display device of claim 3, wherein:

a luminance of the first pixel is higher than a luminance of the second pixel with respect to a same grayscale value;

the first dot conversion unit sums a value obtained by applying a first weight value to the first grayscale value and a value obtained by applying a second weight value to the second grayscale value to set the first corrected grayscale value and the second corrected grayscale value as a sum; and the first weight value is greater than the second weight value.

7. The display device of claim 4, further comprising:

a fourth dot comprising a fourth pixel, a fifth pixel and a sixth pixel, wherein the sixth pixel is located in the first direction from the fourth pixel and the fifth pixel and the fourth pixel is located in the second direction from the fifth pixel;

a fifth dot adjacent to the fourth dot in the second direction; and a sixth dot adjacent to the fourth dot in a direction opposite to the second direction, wherein:

the timing controller is configured to receive grayscale values of the fourth to sixth dots for the image frame from the processor; and the grayscale correction unit further comprises a second dot detection unit configured to output a second detection signal when the fourth dot is determined as a dot adjacent to the edge of the object included in the image frame based on the grayscale values of the fourth to sixth dots.

8. The display device of claim 7, wherein the grayscale correction unit further comprises a second dot conversion unit configured to select one of a fourth grayscale value corresponding to the fourth pixel and a fifth grayscale value corresponding to the fifth pixel based on the second detection signal when the second detection signal is inputted, and generate a third corrected grayscale value by decreasing a selected grayscale value.

9. The display device of claim 8, wherein the data driver supplies a data voltage corresponding to the third corrected grayscale value to the fourth pixel when the second dot conversion unit decreases the fourth grayscale value to generate the third corrected grayscale value.

10. The display device of claim 9, wherein the data driver supplies a data voltage corresponding to the third corrected grayscale value to the fifth pixel when the second dot conversion unit decreases the fifth grayscale value to generate the third corrected grayscale value.

11. The display device of claim 1, wherein the processor provides the first to third grayscale values so that the first to third grayscale values are different from each other and the second grayscale value is a value between the first grayscale value and the third grayscale value when the first dot constitutes an edge dot of a letter in the image frame.

12. The display device of claim 2, wherein the first dot detection unit applies a Prewitt mask of a single row in which the first direction is a row direction to the first to third dots to calculate the edge value of the first dot.

13. The display device of claim 2, wherein the first dot detection unit calculates the edge value of the first dot using a Prewitt mask or a Sobel mask of a plurality of rows in which the first direction is a row direction and the second direction is a column direction.

14. A display device comprising:

a first dot comprising a first pixel, a second pixel, and a third pixel, wherein the third pixel is located in a first direction from the first pixel and the second pixel and the first pixel is located in a second direction from the second pixel;

a second dot adjacent to the first dot in the first direction;

a third dot adjacent to the first dot in a direction opposite to the first direction;

a timing controller configured to receive grayscale values of the first to third dots for an image frame from an external processor;

a grayscale correction unit configured to generate a first corrected grayscale value and a second corrected grayscale value based on a first grayscale value corresponding to the first pixel and a second grayscale value corresponding to the second pixel when the first dot is determined as an edge of an object included in the image frame based on the grayscale values of the first to third dots; and a data driver configured to supply a first data voltage corresponding to the first corrected grayscale value to the first pixel, supply a second data voltage corresponding to the second corrected grayscale value to the second pixel, and supply a third data voltage corresponding to the third grayscale value to the third pixel, wherein:

the grayscale correction unit comprises a first dot detection unit configured to output a first detection signal when an edge value of the first dot calculated based on the grayscale values of the first to third dots is equal to or greater than a threshold value;

the grayscale correction unit further comprises a first dot conversion unit configured to convert the first grayscale value to the first corrected grayscale value and convert the second grayscale value to the second corrected grayscale value when the first detection signal is inputted; and a sum of the first grayscale value and the second grayscale value is equal to a sum of the first corrected grayscale value and the second corrected grayscale value.

15. The display device of claim 14, wherein:

a luminance of the first pixel is lower than a luminance of the second pixel with respect to a same grayscale value; and the first corrected grayscale value is higher than the second corrected grayscale value.

16. The display device of claim 14, wherein:

a luminance of the second pixel is lower than a luminance of the first pixel with respect to a same grayscale value; and the second corrected grayscale value is higher than the first corrected grayscale value.

17. The display device of claim 14, wherein a luminance of the first pixel corresponding to the first data voltage and a luminance of the second pixel corresponding to the second data voltage are the same.

18. A display device comprising:

a first dot comprising a first pixel, a second pixel, and a third pixel, wherein the first pixel is located in a first direction from the second pixel and the first pixel and the second pixel are located in a second direction from the third pixel;

a second dot adjacent to the first dot in the first direction;

a third dot adjacent to the first dot in a direction opposite to the first direction;

a timing controller configured to receive grayscale values of the first to third dots for an image frame from an external processor;

a grayscale correction unit configured to generate a first corrected grayscale value based on a first grayscale value corresponding to the first pixel and a second grayscale value corresponding to the second pixel, and generate a second corrected grayscale value based on the first grayscale value and the second grayscale value, when the first dot is determined as an edge of an object included in the image frame based on the grayscale values of the first to third dots; and a data driver configured to supply a first data voltage corresponding to the first corrected grayscale value to the first pixel, supply a second data voltage corresponding to the second corrected grayscale value to the second pixel, and supply a third data voltage corresponding to a third grayscale value to the third pixel.

19. The display device of claim 18, wherein:

the grayscale correction unit comprises a first dot detection unit configured to output a first detection signal when an edge value of the first dot calculated based on the grayscale values of the first to third dots is equal to or greater than a threshold value.

20. The display device of claim 19, wherein:

the grayscale correction unit further comprises a first dot conversion unit configured to convert the first grayscale value to the first corrected grayscale value and convert the second grayscale value to the second corrected grayscale value when the first detection signal is inputted; and the first corrected grayscale value and the second corrected grayscale value are equal to each other.

* * * * *